US006820761B1

(12) United States Patent
Mouri et al.

(10) Patent No.: US 6,820,761 B1
(45) Date of Patent: Nov. 23, 2004

(54) FOLDING CONTAINER

(75) Inventors: Hitoshi Mouri, Gifu (JP); Histatoshi Yamauchi, Gifu (JP)

(73) Assignee: Sanko Co., Ltd., Motosu-Gun (JP)

( * ) Notice: Subject to any disclaimer, the term of this patent is extended or adjusted under 35 U.S.C. 154(b) by 361 days.

(21) Appl. No.: 09/635,693

(22) Filed: Aug. 10, 2000

(30) Foreign Application Priority Data

Nov. 9, 1999 (JP) ..... 11-317865

(51) Int. Cl.[7] ..... B65D 6/16
(52) U.S. Cl. ..... 220/6; 206/600; 220/7
(58) Field of Search ..... 220/6, 7, 1, 5; 206/600

(56) References Cited

U.S. PATENT DOCUMENTS 1,280,629 A * 10/1918 Appleby ..... 16/337
4,062,467 A * 12/1977 Friedrich ..... 220/7
4,591,065 A * 5/1986 Foy ..... 206/509
5,275,302 A * 1/1994 Uitz ..... 220/4.28
5,398,834 A * 3/1995 Umiker ..... 220/6
5,515,987 A * 5/1996 Jacques et al. ..... 220/6
5,588,549 A * 12/1996 Furtner ..... 220/4.28
5,730,307 A * 3/1998 Karpisek ..... 220/6
5,938,059 A * 8/1999 Luburic ..... 220/6
6,189,695 B1 * 2/2001 Ching-rong ..... 206/509
6,209,741 B1 * 4/2001 Boucher-Giles ..... 220/4.28

FOREIGN PATENT DOCUMENTS

JP 04-44948 * 2/1992 ..... 220/6

* cited by examiner

*Primary Examiner*—Joseph C. Merek
(74) *Attorney, Agent, or Firm*—Westerman, Hattori, Daniels & Adrian, LLP

(57) ABSTRACT

The present invention relates to a folding container having a bottom portion 100 having locking blocks 108, 109, 113 formed thereon and on which the bottom portion of a folded folding container can be fitted, and side walls having recesses 210, 307 formed therein and each having an open underside into which the corresponding locking block of an assembled folding container can be inserted, wherein engagement frame sections 207, 308 are used to mutually engage the side walls and to engage the side walls with the bottom portion. Therefore, folded folding containers can be stably stacked up, and the folding container can be strongly assembled in the form of a box because the engagement frame sections are used to mutually engage the side walls and to engage the side walls with the bottom portion.

3 Claims, 19 Drawing Sheets

FOLDING CONTAINER

FIELD OF THE INVENTION

The present invention relates to a folding container comprising side walls disposed in a fashion surrounding a bottom portion of the container and which can be folded so as to overlap the bottom portion.

BACKGROUND OF THE INVENTION

By way of example, a folding container is conventionally known which comprises long side walls connected via a hinge section to opposed long side portions of a bottom portion of the container formed to have a generally rectangular planar shape and short side walls connected also via a hinge section to opposed short side portions of the bottom portion.

This folding container is configured as follows: to fold the container, the short side walls are folded so as to overlap the bottom portion, and the long side walls are further folded onto the short side walls. Then, to erect the container the folded long side walls are stood up perpendicularly with respect to the bottom portion, and folded short side walls are then stood up perpendicularly with respect to the bottom portion to thereby assemble the box-shaped folder container.

When the folding container is folded, the bottom portion is located at the bottom, the short side walls, which are folded so as to overlap the bottom portion, are located thereof, and the long side walls, which are folded so as to overlap the short side walls, are located thereon. To stack up folding containers folded in this matter, the bottom portion of an upper folded folding container is placed on the long side walls of a lower folded folding container, in addition, the folding container has generally L-shaped fitted shoulder sections, each formed near a corresponding one of the lower corners (located on the bottom portion side) of the long side walls thereof, so that when tile container is folded, the fitted shoulder sections, each having a generally L-shaped planar shape, are each located at a corresponding one of the four corners of the two long side walls. Since the folding container is configured so that in stacking up folded folding containers, the bottom portion of an upper folded folding container is fitted in the shoulder sections located-at the four corners of the two long sidewalls of a lower folded folding container, horizontal movement of the upper folded folding container relative to the lower folded folding container is limited to allow a large number of folded folding containers to be stacked up stably to prevent collapse.

As described above, in the conventional folding container, the fitted shoulder sections are each formed near the corresponding one of the lower corners of the long side walls of the folding container so as to stably stack up folded folding containers. In the assembled folding container, however, the fitted shoulder sections project from the long side walls. Consequently, if two assembled folding containers are arranged in juxtaposition in a manner such that the long side walls of one of the containers abut on the corresponding long side walls of the other, an unwanted gap is created between the folding containers arranged in juxtaposition to increase a storage space for the assembled folding containers, thereby reducing storage efficiency. In addition, the fitted shoulder sections disadvantageously increase the thickness of each long side wall, so that the assembled folding container has a small internal volume compared to its outside dimensions, resulting in a reduced accommodation efficiency.

Additionally, since the long side walls insufficiently engage with the short side walls when the conventional folding container is assembled, the long and short side walls may be mutually disengaged when a load is imposed on these side walls from above, for example, when the assembled folding containers are stacked up.

Further, when a load is imposed on the long and short side walls of the conventional folding container from above, this load is effected on the hinge section coupling the bottom portion to the long and short side walls, whereby the hinge section may be damaged.

Further, since the conventional folding container has a problem with the structure of the hinge section coupling the bottom portion to the long and short side walls, it cannot be assembled easily by hinging the bottom portion to the long and short side walls.

Additionally, card holders disposed on the conventional folding container are manufactured separately from the other components before being attached to the long or short side walls. This attachment requires a large amount of time and labor to increase the price of the folding container.

SUMMARY OF THE INVENTION

It is an object of the present invention to solve the above described problems with the conventional folding container to provide a folding container that can be handled more easily and accommodated more efficiently.

To attain this object, the present invention is a folding container comprising side walls disposed in a fashion surrounding a bottom portion thereof and which can be folded so as to overlap the bottom portion, the side walls each having engagement frame sections formed thereon for mutually engaging the adjacent side walls so that when stood up perpendicularly to the bottom portion, the side walls will not fall down inward. In this folding container, first, the bottom portion has locking blocks formed thereon and on which the bottom portion of an assembled folding container can be fitted, the side walls each have recesses formed therein and each having an open underside into which the corresponding engagement block of an assembled folding container can be inserted, and the engagement frame sections are used to mutually engage the side walls and to engage the side walls with the bottom portion. Second, one of the opposed side walls has through-holes into which the corresponding engagement block, which projects upward, can be inserted upon folding. Third, engagement projections formed on the engagement frame sections of each side wall are configured to fit in the corresponding through-hole in each fitting section formed in the bottom portion. Fourth, when the side walls are stood up perpendicularly to the bottom portion, a bottom surface of each side wall partly comes in surface contact with a top surface of the bottom portion. Fifth, card presser pieces each constituting a card holder are integrated with the side wall via a thin connection section.

DETAILED DESCRIPTION OF THE PREFERRED EMBODIMENTS

Figure 1:
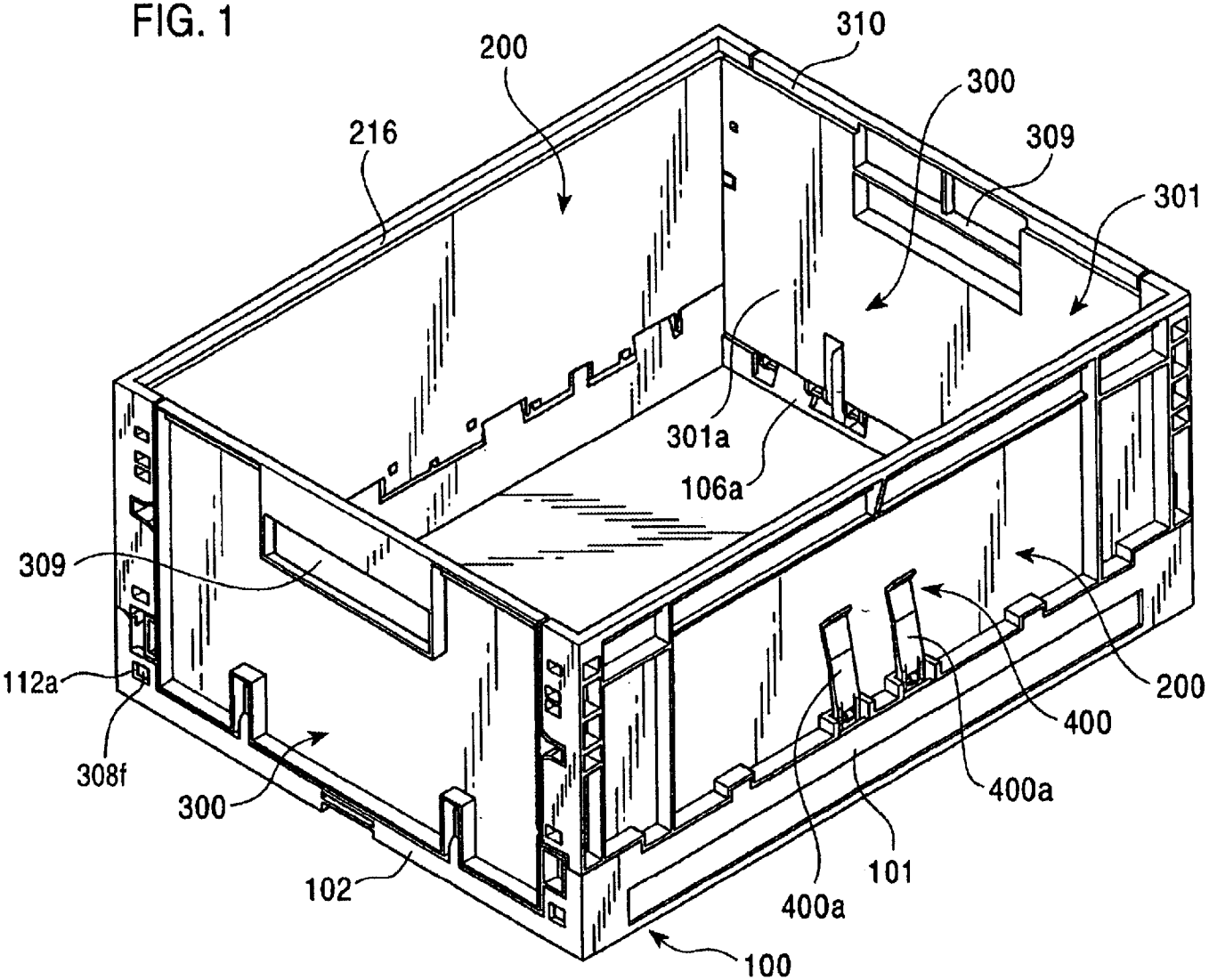
FIG. 1 is a perspective view showing how a folding container according to the present invention is assembled.

An embodiment of the present invention will be described below, but the present invention is not limited to this embodiment as long as the spirits thereof are maintained.

100 is a bottom portion having a rectangular planar shape. The bottom portion 100 comprises opposed long side portions 101 each having a long side wall 200 connected thereto via a hinge section, described later, and opposed short side portions 102 each having a short side wall 300 connected thereto also via a hinge section.

Figure 2:
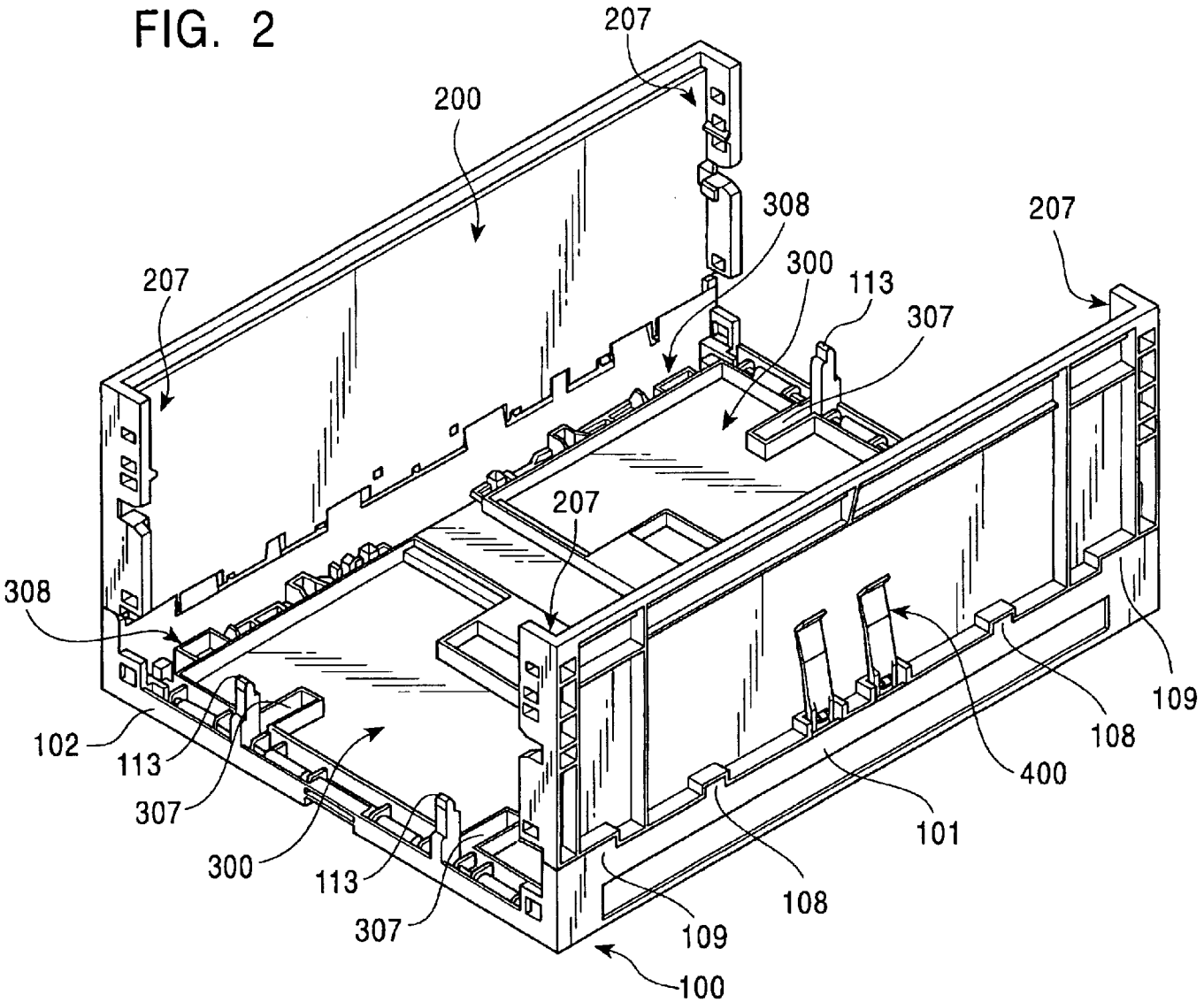
FIG. 2 is a perspective view showing the folding container according to the present invention in an intermediate condition of assembly.
Figure 3:
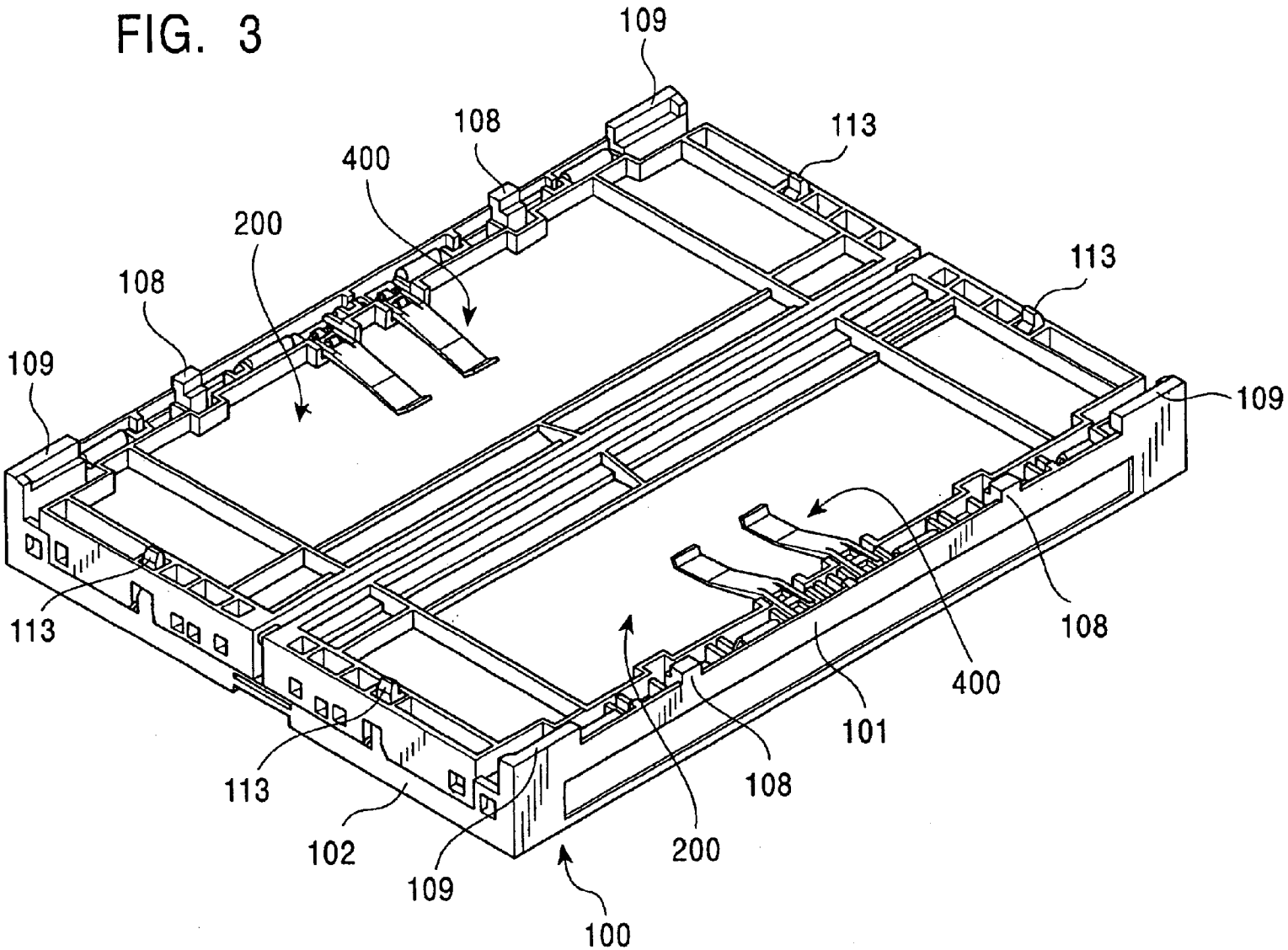
FIG. 3 is a perspective view showing the folding container according to the present invention in a folded condition.
Figure 4:
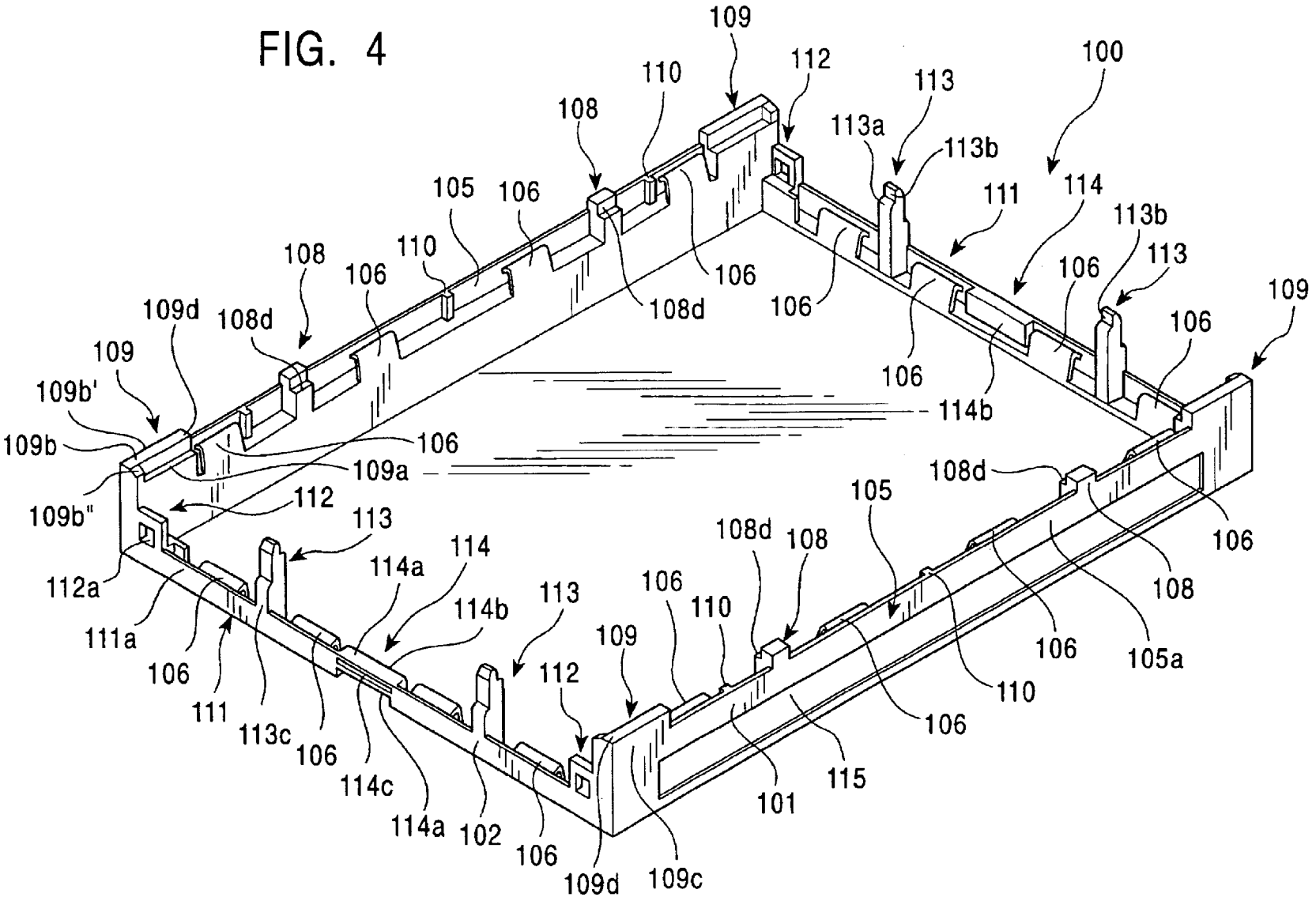
FIG. 4 is a perspective view of a bottom portion of the folding container according to the present invention.
Figure 5:
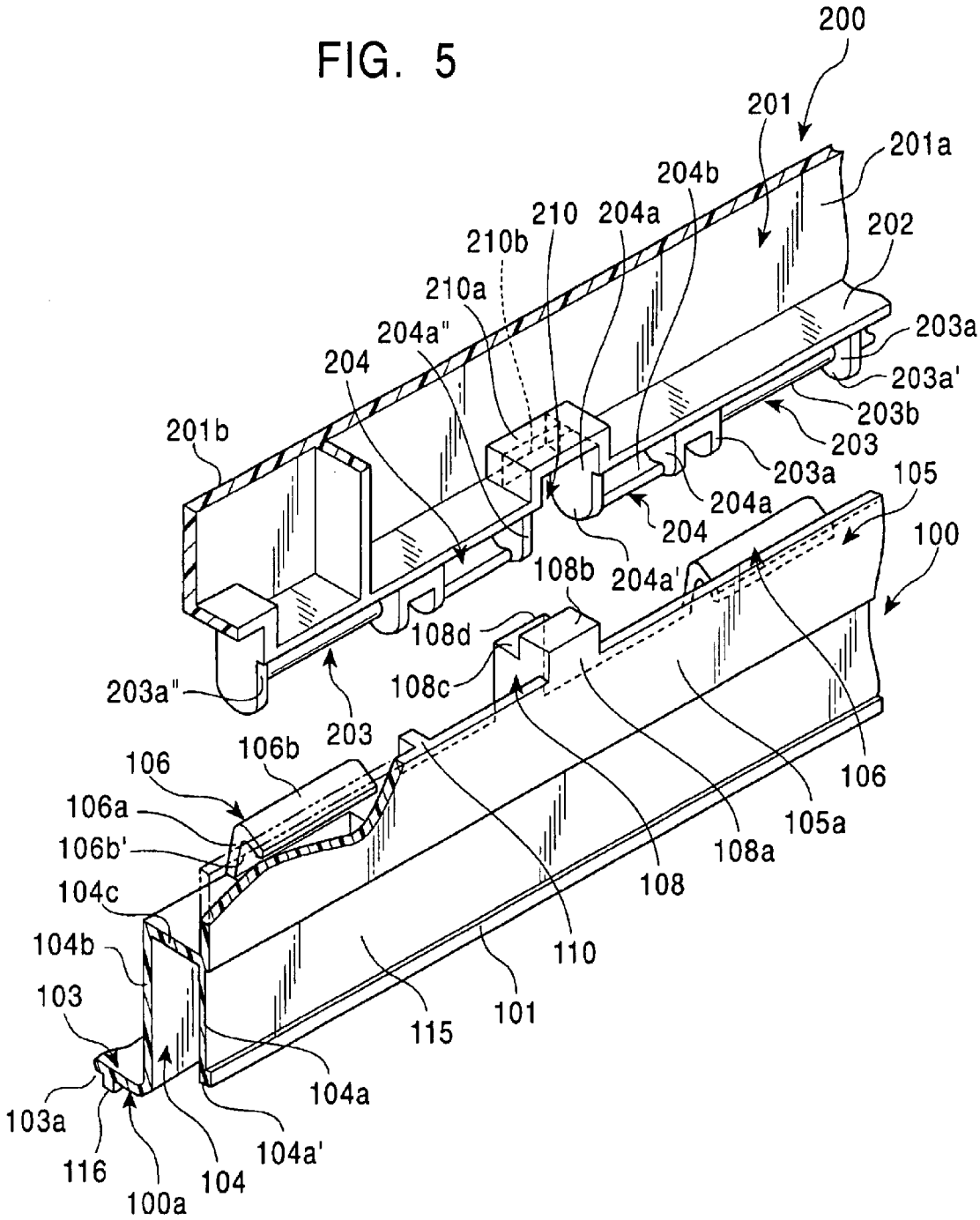
FIG. 5 is an exploded fragmentary perspective view showing the bottom portion and long side walls of the folding container according to the present invention to explain hinging between the bottom portion and the long side walls.
Figure 6:
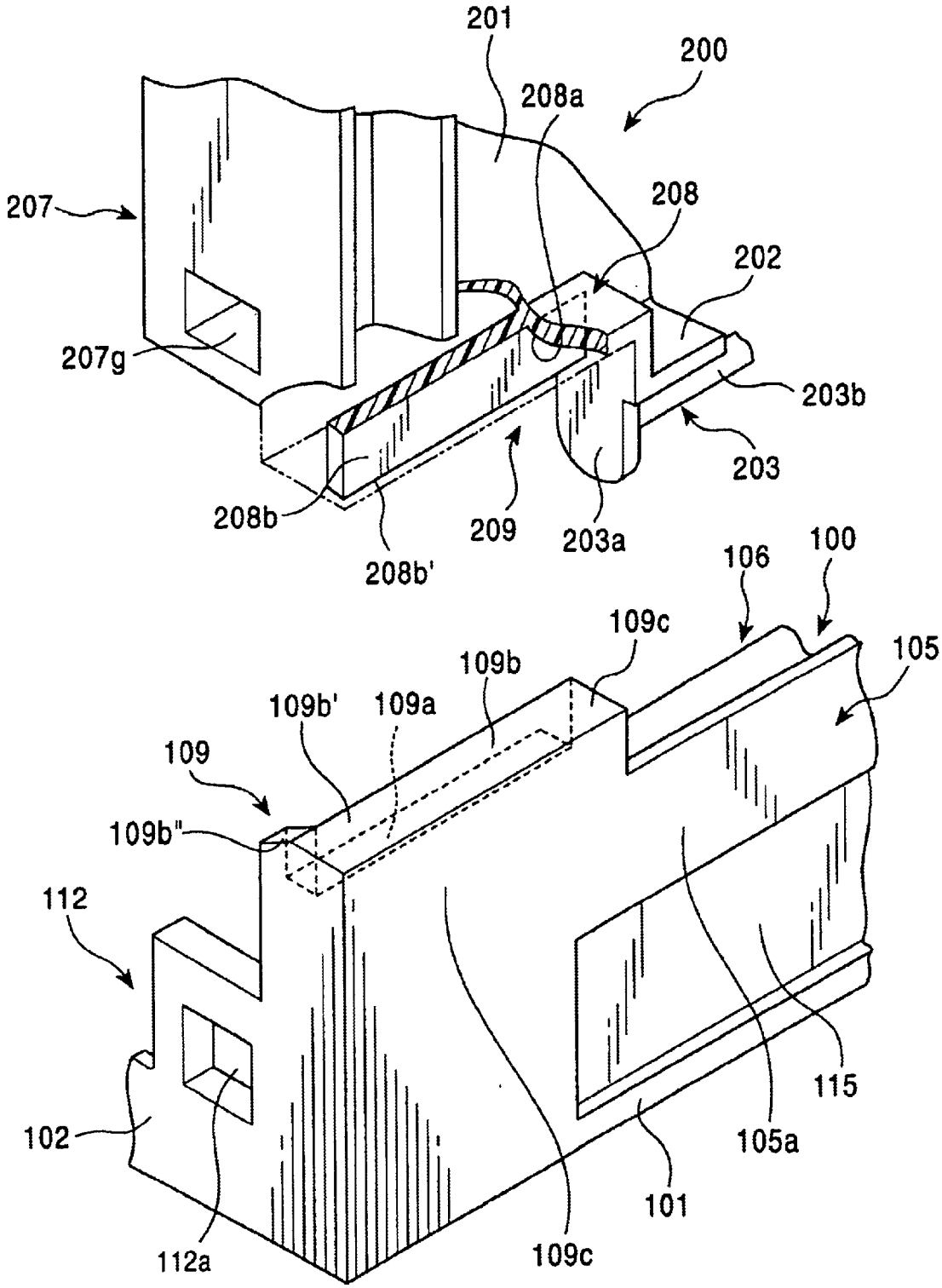
FIG. 6 is an exploded fragmentary perspective view of regions of ends of the bottom portion and long side walls of the folding container according to the invention.
Figure 7:
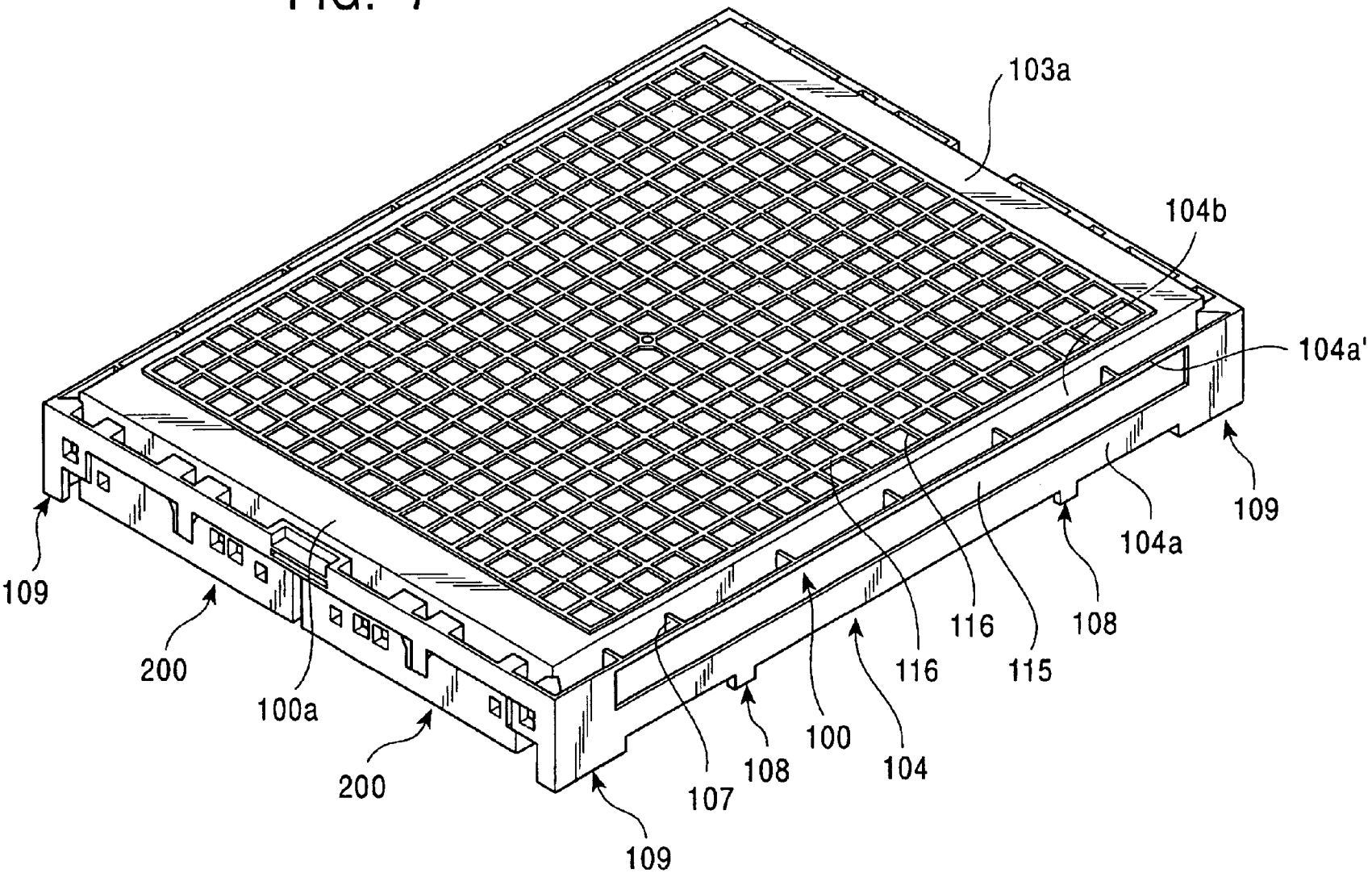
FIG. 7 is a rear perspective view showing how the folding container according to the present invention is folded.
Figure 8:
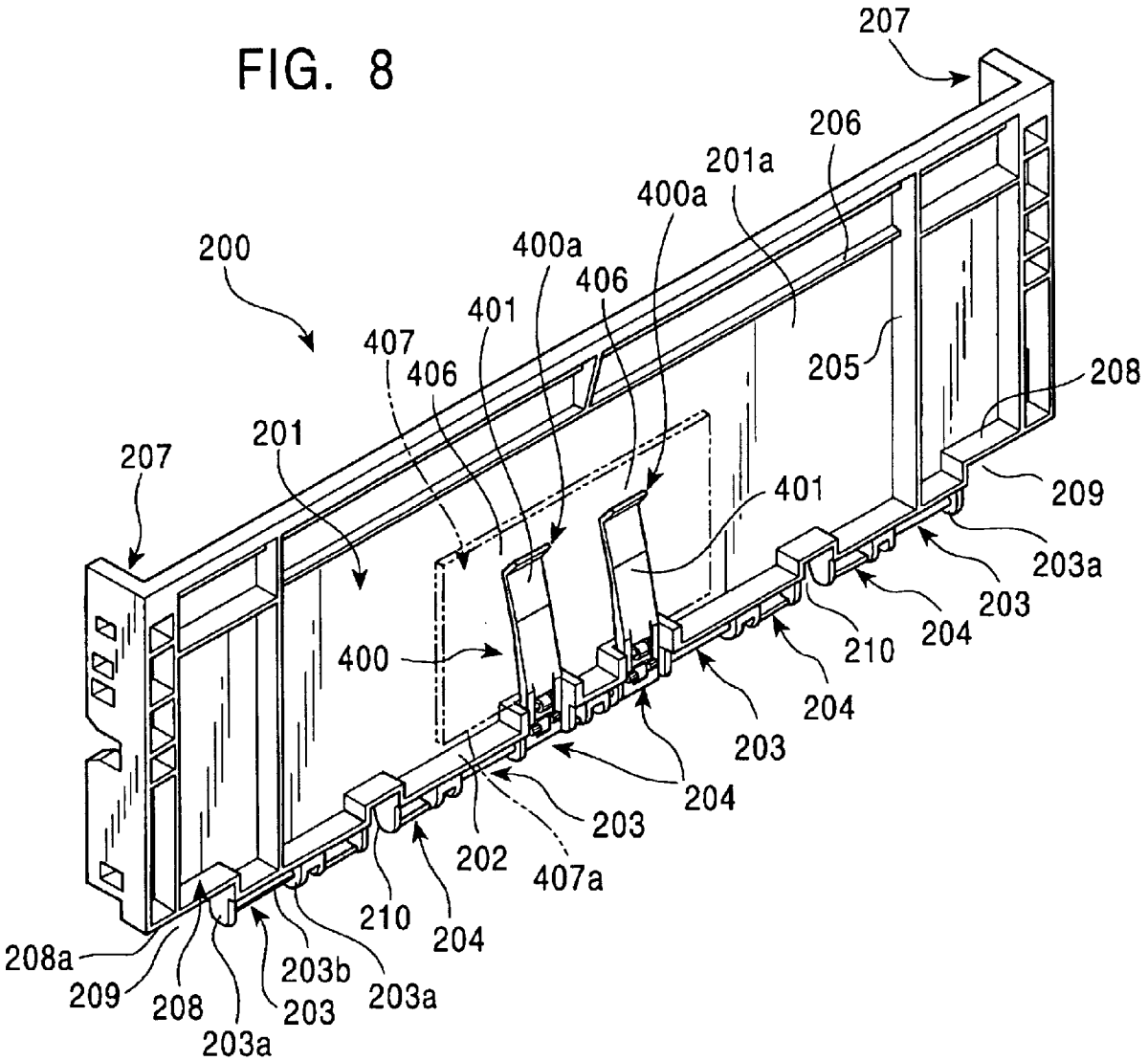
FIG. 8 is a perspective view of the long side wall of the folding container according to the present invention.
Figure 9:
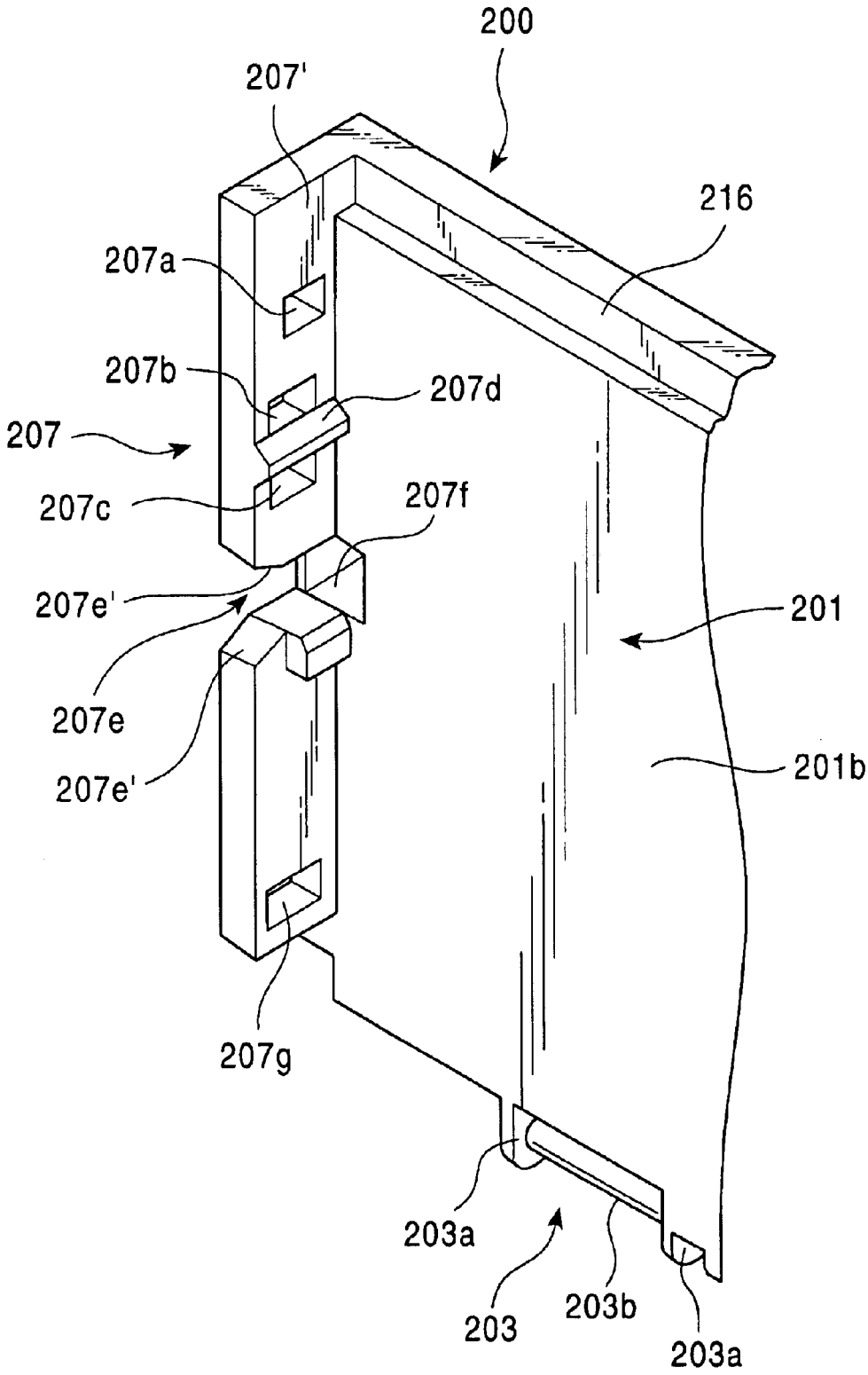
FIG. 9 is a fragmentary perspective view of the long side wall of the folding container according to the present invention.

As shown in FIG. 1, to fold a folding container assembled in the form of a box, the short side walls 300 are first brought down inward of the folding container to overlap the bottom portion 100, as shown in FIG. 2. Then, the long side walls 200 are similarly brought down inward of the folding container to overlap the bottom portion 100 and the short side walls 300, as shown in FIG. 3. On the contrary, to assemble, as shown in FIG. 1, the folding container folded as shown in FIG. 3, the long side walls 200, overlapping the bottom portion 100 and the short side walls 300, are stood up perpendicularly, and the short side walls 300 are stood up perpendicularly to assemble the folding container in the form of the box.

Next, the bottom portion 100 will be explained chiefly with reference to FIGS. 4 to 7.

The bottom portion 100 has a bottom plate 103 having an inverted generally U-shaped double wall section 104 formed at each long side edge thereof, the double wall section 104 constituting the long side portion 101 of the bottom portion 100. The double wall section 104 comprises an outer wall 104*a*, an inner wall 104*b*, and a horizontal wall 104*c* connecting an upper end of the outer wall 104*a* and an upper end of the inner wall 104*b* together. A rear surface 103*a* of the bottom plate 103 is located below a lower end 104*a*' of the outer wall 104*a*, and a portion of the bottom plate 103 which is located below the lower end 104*a*' of the outer wall 104*a* constitutes a bottom fitting section 100*a*, described later. The outer wall 104*a* constituting the double wall section 104 is extended upward to form a laterally elongated end wall 105 all along the long side portion 101 except for both ends thereof.

In addition, plate pieces 106*a* are extended upward generally perpendicularly from the upper end of the inner wall 104*b* constituting the double wall section 104. Each of the plate pieces 106*a* has a generally semicylindrical hook 106*b* connected thereto and disposed on the end wall 105 side relative to the plate piece 106*a*, so that the plate piece 106*a* and the hook 106*b* constitute an inverted generally J-shaped hinge female section 106. The hinge female section 106 has almost the same height as the end wall 105, and an appropriate number of hinge female sections 106 are formed along the long side portion 101 (in this embodiment, four hinge female sections 106 are formed at almost equal intervals). Inside the double wall section 104, internal reinforcing ribs 107 can be formed at appropriate intervals for connecting the outer wall 104*a*, the inner wall 104*b*, and the horizontal wall 104*c* together.

A long-side locking block 108 having an outer surface 108*a* substantially flush with an outer surface 105*a* of the end wall 105 is formed in each corner formed of the end wall 105 and the horizontal wall 104*c* of the double wall section 104, the corner being situated between the hinge female section 106 located near each of the opposite ends of the long side portion 101 and the hinge female section 106 located closer to the center of the long side portion than the first hinge female section 106. The long-side locking block 108 comprises a notch portion 108*d* facing inward and having a projecting portion 108*b* extending upward above the end wall 105 and a placement surface 108*c* located at almost the same height as an upper end of the end wall 105.

The long side portion 101 has an end locking block 109 formed at each of the opposite ends thereof by extending the outer wall 104*a* and inner wall 104*b* of the double wall section 104 upward, the end locking block 109 being substantially as high as the long side locking block 108. The end locking block 109 has a placement surface 109*a* having substantially the same height as the placement surface 108*c* of the long-side locking block 108 and a projecting portion 109*b* projecting upward from the placement surface 109*a*.

The projecting portion 109*b* comprises a projecting sub-portion 109*b*' extending along the long side portion 101 and a projecting sub-portion 109*b*" extending perpendicularly to the projecting sub-portion 109*b*' in the direction of the short side portion 102, and is formed to have a generally L-shaped planar shape. The end locking block 109 has an outer surface 109*c* also formed to be substantially flush with the outer surface 105*a* of the end wall 105, 110 is a reinforcing block formed as appropriate in a corner formed of the end wall 105 and the horizontal wall 104*c* of the double wall section 104. An upper end of the reinforcing block 110 is aligned with the upper end of the end wall 105 but can be located therebelow as required.

The short side portion 102 of the bottom portion 100 is formed below the long side portion 101, and has a vertical wall 111 extending upward generally perpendicularly from the bottom plate 103 along each short side edge thereof. The bottom plate 103 has hinge female sections 106 similar to those described above, formed thereon close to the vertical wall 111 at predetermined intervals (in this embodiment, four hinge female sections 106 are formed at almost equal intervals).

A generally square fitting section 112 with a through-hole 112*a* formed therein is formed by extending upward a corresponding one of the opposite ends of the vertical wall 111 constituting the short side portion 102. The fitting section 112 is configured to be lower than the end locking block 109 formed at each of the opposite ends of the long side portion 101 and is configured so that a fitting projection formed on the short side wall 300, described later, is fitted in the through-hole 112*a*. A short-side locking block 113 is formed in each corner formed of the vertical wail 111 of the short side portion 102 and the bottom plate 103. The short-side locking block 113 is formed to be substantially as high as the long-side locking block 108 and end locking block 109 described above, and has a notch portion 113*b* facing inward and forming a placement surface 113*a* at almost the same height as the placement surface 108*c* of the long-side locking block 108 and the placement surface 109*a* of the end locking block 109. In addition, an outer surface 113*c* of the short-side locking block 113 is formed to be flush with the outer surface 111*a* of the vertical wall 111 constituting the short side portion 102 and is at least configured so as not to project outward beyond an outer surface 111*a* of the vertical wall 111.

114 is a catching section formed in a middle portion of the short side portion 102 and having a recess 114*c* formed therein, which is formed of a pair of horizontal frames 114*a*, 114*a* arranged at a predetermined interval and of a rear frame 114*b*, and which is open on the outside so that jaws of an automatic machine such as a robot, an operator's fingers, or the like can be inserted into the catching section. The catching section 114 is formed by cutting the middle portion of the vertical wall 111 by a distance corresponding to the width of the catching section 114. 115 is a recess formed in the outer wall 104*a* of the double wall section 104 constituting the long side portion 101 of the bottom portion 100. The recess 115 is configured so that a label, a bar code, a magnetic tape, or the like that stores various information on the folding container and articles accommodated therein such as the destination of the articles, type, and number of the articles is stuck thereto. 116 is a low reinforcing rib formed in the rear surface 103*a* of the bottom plate 103 to run in both vertical and lateral directions as required.

As described later, card holders are disposed on the short side walls 300 or the long side walls 200, and the recess 115 for printing and label sticking is further formed in the outer wall 104*a* of the double wall section 104 of the bottom portion 100, as described above, thereby allowing easy and reliable identification of various information such as the type and destination of the articles accommodated in the folding container.

Further, if the sizes of the folding containers vary, in other words, the sizes of the long side walls 200 or short side walls 300 vary, the positions of the label sticking sections or card holders provided on the long side walls 200 or the short side walls 300 may vary significantly. Despite the different sizes of the folding containers, the positions of the bottom portions 100, particularly, their height do not vary significantly. Thus, if a read sensor of a reader disposed near a transfer device is used to read a label printed on or stuck to the recess 115 for printing or label sticking formed in the outer wall 104*a* of the double wall section 104 or the bottom portions 100 in the middle of being transferred to the transfer device such as a belt conveyer, it can accurately and reliably read the various information such as the type and destination of the articles accommodated in the folding container because the positions of the recesses 115 for printing and label sticking do not vary significantly despite the different sizes of the folding containers. This configuration can prevent failures in reading arising from the different positions of the label sticking sections and eliminates the need to change the position of the read sensor of the reader depending on the size of the folding container.

Next, the long side wall 2 will be described with reference to FIGS. 2, 5, 6, and 8 to 10.

The long side wall 200 has a laterally elongated rectangular plate section 201 and a lower horizontal frame 202 extending outward from a lower end of the plate section 201. The lower horizontal frame 202 has hinge male sections 203 formed on a bottom surface thereof and corresponding to the hinge female sections 106 formed on the long side portion 101 side of the bottom portion 100. Each of the hinge male sections 203 comprises a pair of vertical pieces 203*a* suspending from the lower horizontal frame 202 perpendicularly to the plate section 201 and a horizontal pin 203*b* disposed between the pair of vertical pieces 203*a*. The vertical pieces 203*a* each have its lower part formed into a semicircular portion 203*a*'.

204 is a lower block formed on a bottom surface of the lower horizontal frame 202 and comprising a pair of vertical pieces 204*a* similar to the above vertical pieces 203*a* and a connection wall 204*b* connecting the vertical pieces 204*a* together. The connection wall 204*b* has its lower end formed into a semicylindrical portion bent in almost the same manner as a semicircular portion 204*a*' of the vertical piece 204*a*. A lower end of the lower block 204 is aligned with a lower end of a vertical piece 203*c* of the hinge male section 203, and the semicircular portion 204*a*' of the vertical piece 204*a* of the lower block 204 and the semicylindrical portion of the connection wall 204*b* have almost the same radius as the semicircular portion 203*a*' of the vertical piece 203*a* of the hinge male section 203.

An end-wall-105-side end surface 203*a*" of the vertical piece 203*a* of the hinge male section 203 and an end-wall-105-side end surface 204*a*" of the vertical piece 204*a* of the lower block 204 recede from the lower horizontal frame 202 by a distance substantially equal to the thickness of the end wall 105. When the bottom portion 100 and the long side walls 200 are hinged using the hinge female sections 106 and hinge male sections 203 described above and the long side walls 200 are stood up perpendicularly to the bottom portion 100, the end wall 105 of the bottom portion 100 slides into a space formed due to the recession from the lower horizontal frame 202 of the vertical piece 203*a* of the hinge male section 203 and the vertical piece 204*a* of the lower block 204, so that the bottom surface of the lower horizontal frame 202 of the long side wall 200 abuts on an upper end of the end wall 105 (in particular, see FIG. 14, described later). Since the bottom surface of the lower horizontal frame 202 of the long side wall 200 is configured to abut on the upper end of the end wall 105, a load imposed on the long side wall 200 from above is shared by the upper end of the end wall 105 and the bottom surface of the lower horizontal frame 202 of the long side wall 200 which are in mutual abutment, thereby precluding such a load from being effected on the hinge female sections 106 and the hinge male sections 203. This in turn prevents the hinge female sections 106 and the hinge male sections 203 from being damaged or disengaged.

The plate section 201 has a plurality of vertical ribs 205 and horizontal ribs 206 formed on an outer surface 201*a* thereof as appropriate. When the folding container is assembled and the long side walls 200 are stood up perpendicularly to the bottom portion 100, an inner surface 201*b* of the plate section 201 is substantially flush with the inner wall 104*b* of the double wall section 104 constituting the long side portion 101 of the bottom portion 100, an inner surface of the plate piece 106*a* of the hinge female section 106, and the like. When the folding container is assembled, no projecting portion is formed on a long-side-wall-200-side inner surface of the folding container. Additionally, when the folding container is assembled, the vertical ribs 205 and the horizontal ribs 206 do not project outward beyond the outer wall 104*a* of the double wall section 104 constituting the long side portion 102 of the bottom portion 100.

Figure 10:
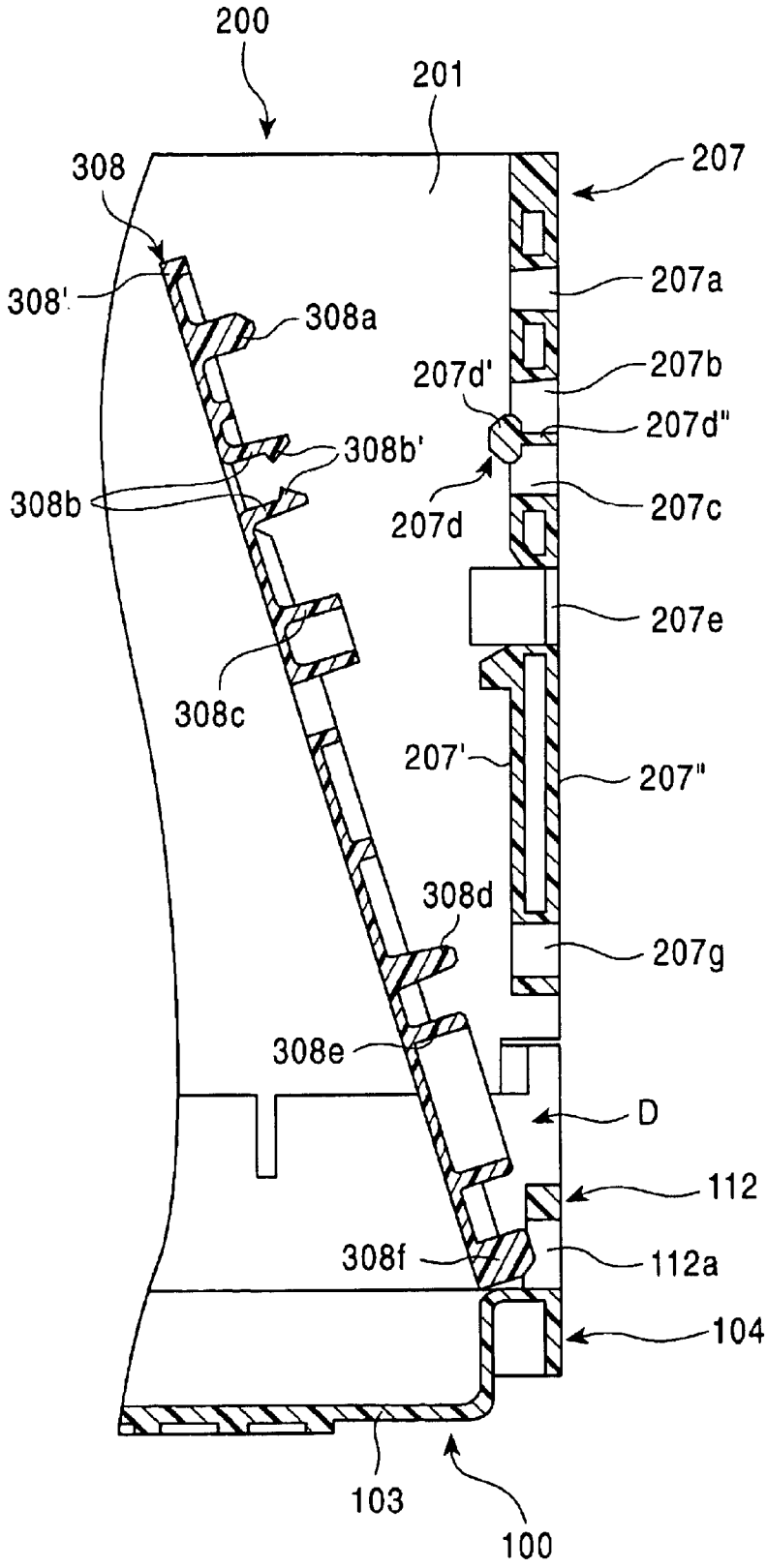
FIG. 10 is a vertical sectional view of the long side wall and a short side wall of the folding container according to the present invention before engagement frame sections of the long and short side walls are mutually

The long side wall 200 has an engagement frame section 207 formed at each of the opposite ends thereof and extending perpendicularly to the plate section 201 toward the inner surface 201*b*, and the engagement frame section 207 has an upper fitting through-hole 207*a* formed in an upper part thereof and two through-holes 207*b*, 207*c* formed in a lower part thereof and between which a horizontal laterally elongated engagement projection 207*d* is provided on an inner surface 207' of the engagement frame section 207. As shown in FIG. 10, a cross section of the engagement projection 207*d* is shaped like turned-sideways mushroom formed of a swollen portion 207*d*' with a tapered tip portion and of a horizontal portion 207*d*" extending from the swollen portion 207*d*' toward an outer surface 207" of the engagement frame section 207. Further, a fitting recess 207*e* is formed below the engagement projection 207*d* by partly notching the engagement frame section 207, and the long side wall 200, having the fitting recess 207*e* located therein, has a fitting through-hole 207*f* formed therein. In addition, a lower fitting through-hole 207*g* is formed below the fitting recess 207*e*. The upper fitting through-hole 207*a*, through-holes 207*b*, 207*c*, and lower fitting through-hole 207*g* formed in the engagement frame section 207 are formed in substantially parallel with the plate section 201, in other words, perpendicularly to the inner surface 207' and outer surface 207" of the engagement frame section 207. In addition, the engagement frame section 207 has its bottom surface located above the lower horizontal frame 202. The fitting through-hole 207*f* is configured so that the short-side locking block 113 formed on the bottom portion 100 is inserted into the fitting through-hole 207*f* as shown in FIG. 3 when the long side walls 200 are folded so as to overlap the folded short side walls 300 while the folding container is being folded.

The long side wall 200 has notch portions 209 at lower opposite ends thereof, which are each formed of a horizontal frame 208 higher than the lower horizontal frame 202 and the vertical piece 203*a* of the hinge male section 203. The notch portion 209 is configured so that when the long side walls 200 are attached to the bottom portion 100 and stood up perpendicularly to the bottom portion 100, the end locking blocks 109 can slide into the corresponding notch portions 209 without interfering with the long side walls 200. When a load is imposed on the long side wall 200 from above, a bottom surface 208*a* of the horizontal frame 208 formed at each of the lower opposite ends of the long side wall 200 comes in surface contact with the top surface 109*d* of the end locking block 109 formed on the bottom portion 100 to share the load on the long side wall 200. This configuration prevents the mutually coupled hinge female sections 106 and hinge male sections 203 from being damaged by the load on the long side wall 200, as described later.

When the folding container is assembled, the upper ends of the short side walls 300 are slightly lower than the upper ends of the long side walls 200. With this configuration, if a load is imposed on the folding container from above, for example, if a large number of folding containers accommodating articles are stacked up, the long side walls 200, which can withstand loads well, come in surface contact with the bottom portion 100 to share most of the load, whereas the short side walls 300, which cannot withstand loads well, do not form such a surface contact and are not be subjected to the load.

Consequently, the load on a hinging section comprising the hinge female sections 106 and the hinge male sections 203 and hinging the bottom portion 100 to the short side walls 300 decreases to prevent damage to the hinge female sections 106 and the hinge male sections 203 hinging the bottom portion 100 to the short side walls 300.

In addition, the horizontal frame 208 has an impact wall 208*b* suspending from a bottom surface thereof and formed on an extension of the plate section 201. The impact wall 208*b* has its lower end configured to be substantially flush with a bottom surface of the lower horizontal frame 202. The impact wall 208*b* is configured so that when the long side wall 200 is stood up perpendicularly to the bottom portion 100, a lower end 208*b*' of the impact wall 208*b* is located close to or in abutment with the placement surface 109*a* of the end locking block 109 of the bottom portion 100, with the impact wall 208*b* coming in abutment with an inner surface of the projecting portion 109*b*' of the end locking block 109, the projecting portion 109*b*' extending along the long side portion 101 of the end locking block 109.

When the folded long side wall 200 is rotatively moved to a vertical direction of the folding container, the impact wall 208*b* comes in abutment with the inner surface of the projecting portion 109*b*' of the end locking block 109 formed on the bottom portion 100, the projecting portion 109*b*' extending along the long side portion 101, to hinder the long side wall 200 from rotatively moving beyond its vertical position, thereby preventing damage to the hinge section comprising the hinge female sections 106 and the hinge male sections 203. In addition, when the long side wall 200 is stood up perpendicularly to the bottom portion 100, the lower end 208*b*' of the impact wall 208*b* is located close to or in abutment with the placement surface 109*a* of the end locking block 109 of the bottom portion 100, thereby allowing a load imposed on the long side wall 200 from above is shared by the impact wall 208*b* and the end locking block 109 to prevent the hinge section from being subjected to the load and thus being damaged.

210 is a recess having an open underside and formed by swelling the lower horizontal frame 202 upward. The recess 210 is configured so that when the bottom portion 100 is attached to the long side wall 200, which is then stood up perpendicularly to the bottom portion 100, the long side locking blocks 108 formed on the bottom portion 100 can each slide into this recess. In this embodiment, the recess 210 is formed of the pair of vertical pieces 204*a* of the lower block 204 and a top portion 210*a*. An impact wall 210*b* formed on an extension of the plate section 201 is formed above the recess 210, and has a lower end configured to substantially flush with a bottom surface of the lower horizontal frame 202. When the long side wall 200 is stood up perpendicularly to the bottom portion 100, a lower end of the impact wall 210*b* is located close to or in abutment with the placement surfaces 108*c* of the long-side locking blocks 108, with the impact wall 210*b* coming in abutment with the projecting portions 108*b* of the long-side locking blocks 108.

When the folded long side wall 200 is rotatively moved in the vertical direction, the impact wall 210*b* comes in abutment with the projecting portions 108*b* of the long-side locking blocks 108 formed on the bottom portion 100 to hinder the long side wall 200 from rotatively moving beyond its vertical state, thereby preventing damage to the hinge section comprising the hinge female sections 106 and the hinge male sections 203. In addition, when the long side wall 200 is stood up perpendicularly to the bottom portion 100, a lower end of the impact wall 210*b* is located close to or in abutment with the placement surfaces 108*c* of the long-side locking blocks 108 of the bottom portion 100, thereby allowing a possible load on the long side wall 200 from above is shared by the impact wall 210*b* and the long-side locking blocks 108 to prevent the hinge section from being subjected to the load and thus from being damaged.

A gap is formed between each of the above described end wall 105 of the bottom portion 100 and the above described hook 106*b* of each hinge female section 106 formed on the bottom portion 100 and has an interval smaller than the diameter of the horizontal pin 203*b* of each hinge male section 203 formed on the long side wall 200.

Next, the short side wall 300 will be explained with reference to FIGS. 1 and 10 to 13.

Like the above described long side wall 200, the short side wall 300 has a laterally elongated rectangular plate section 301 and a lower horizontal frame 302 extending outward from a lower end of the plate section 301. The lower horizontal frame 302 has hinge male sections 303 formed on a bottom surface thereof and corresponding to the hinge female sections 106 formed on the short side portion 102 side of the bottom portion 100. Like the hinge male section 203 formed on the above described long side wall 200, each hinge male section 303 comprises a pair of vertical pieces 303*a* extending perpendicularly to the plate section 301 and a horizontal pin 303*b* disposed between the pair of vertical pieces 303*a*. The vertical pieces 303*a* each have its lower part formed into a semicircular portion 303*a'*.

Figure 11:
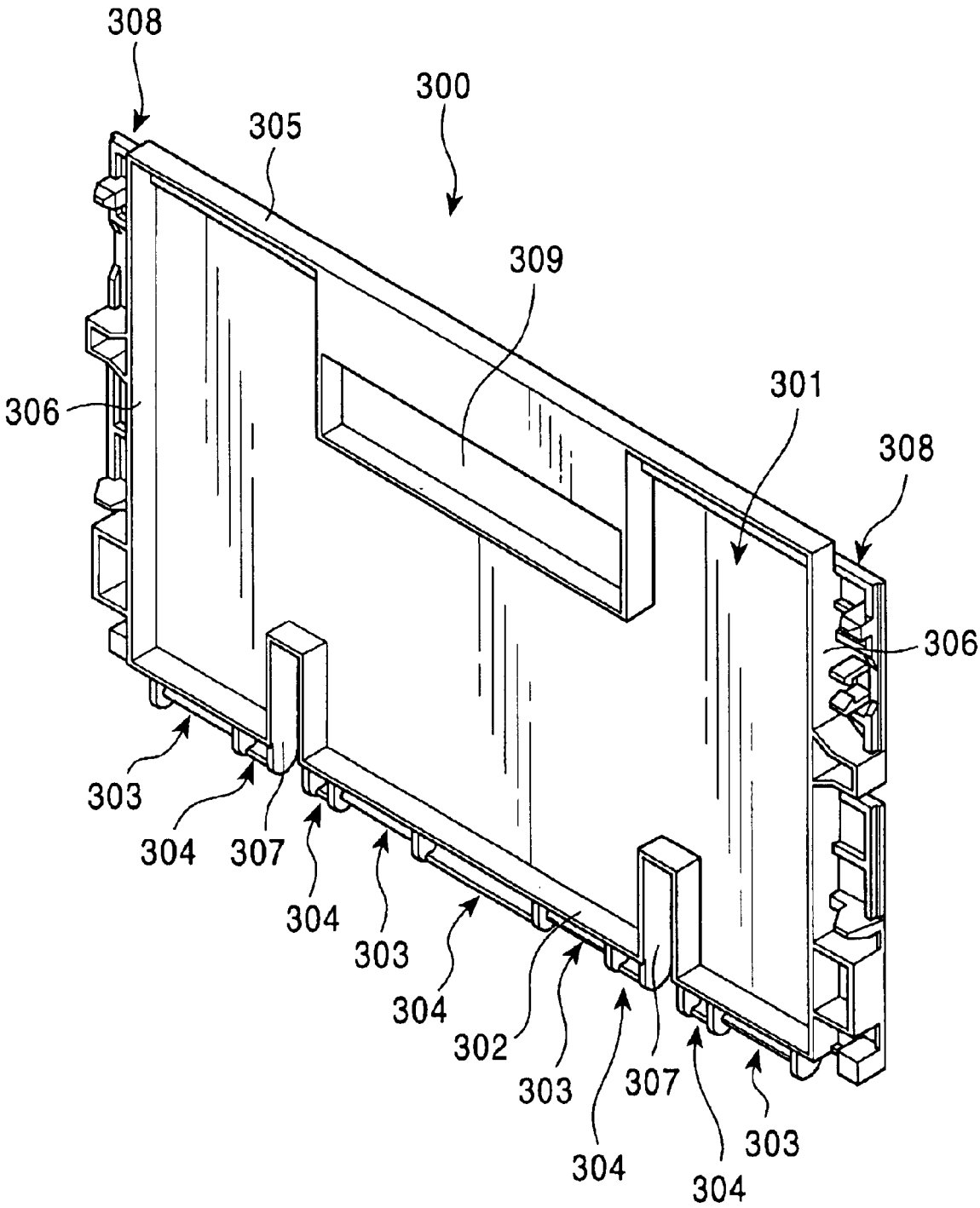
FIG. 11 is a perspective view of the short side wall of the folding container according to the present invention.
Figure 12:
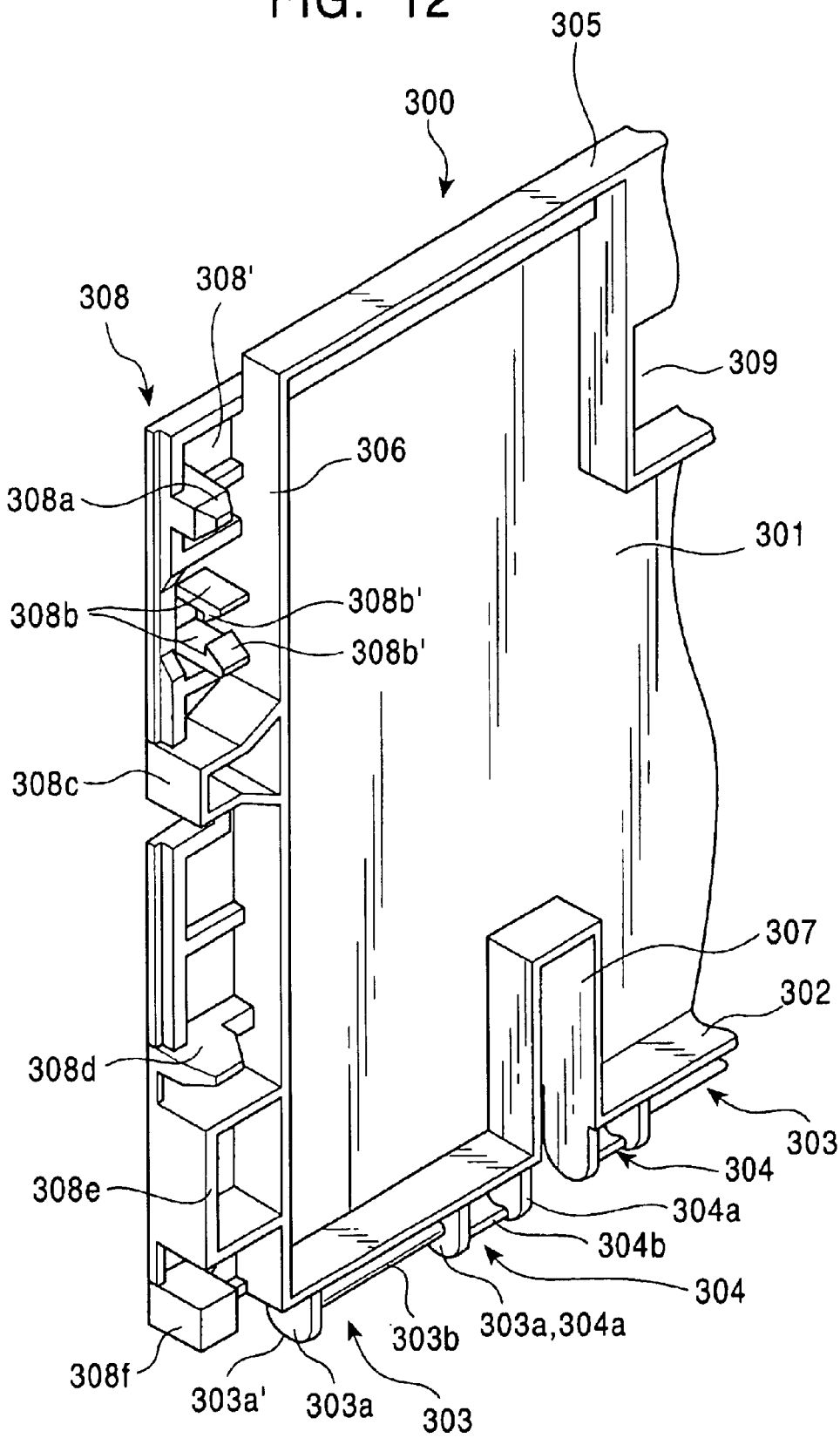
FIG. 12 is a fragmentary perspective view of the short side wall of the folding container according to the present invention.
Figure 13:
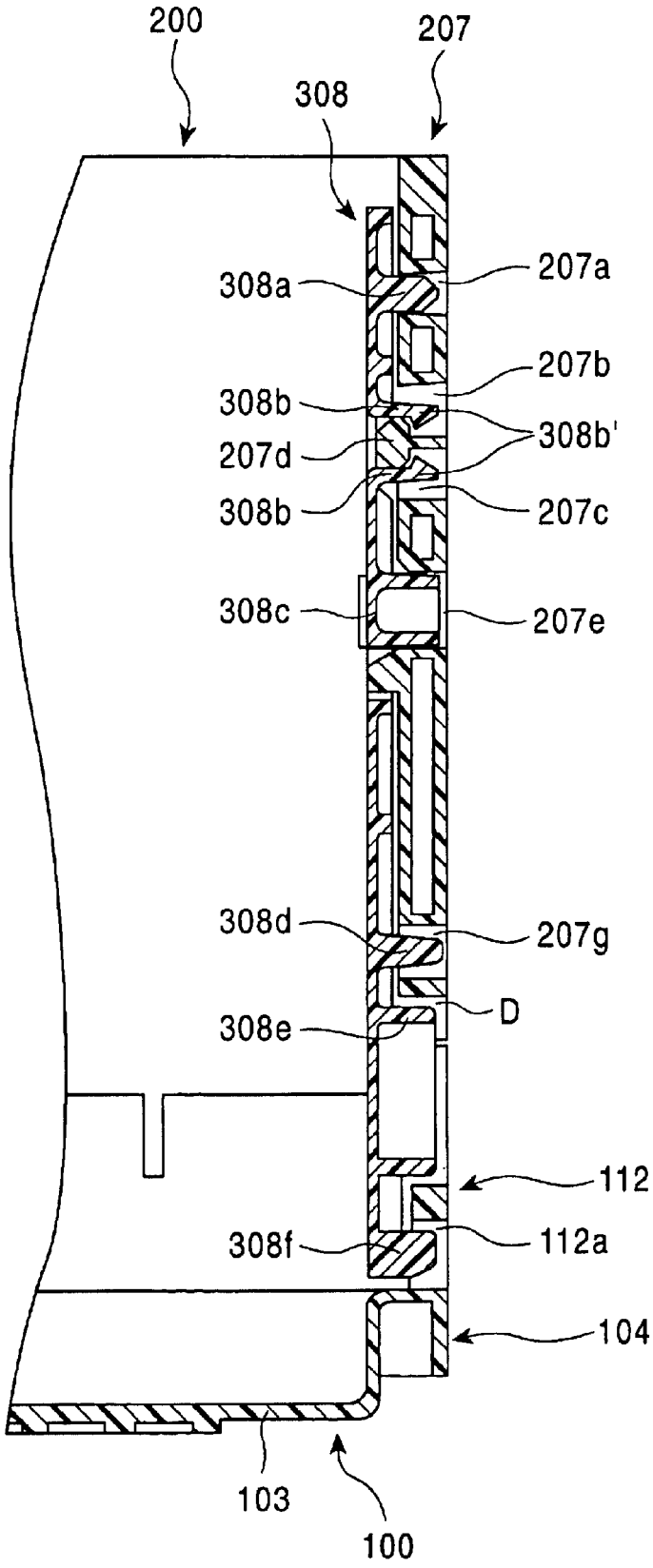
FIG. 13 is a vertical sectional view of the long side wall and short side wall of the folding container according to the present invention after the engagement frame sections of the long and short side walls have been mutually

In addition, the lower horizontal frame 302 has a lower block 304 formed on a bottom surface thereof and which is similar to the lower block 204 formed on the long side wall 200 and which comprises a pair of vertical pieces 304*a* and a connection wall 304*b* connecting the vertical pieces 304*a* together. This embodiment shows an example in which the vertical pieces 304*a* of the lower block 304 and the vertical pieces 303*a* of the hinge male sections 303 are shared between the hinge male section 303 and the lower block 304 disposed adjacent to the hinge male section 303, as shown in FIG. 11.

The plate section 301 has an upper horizontal frame 305 formed at an upper end thereof and opposed vertical frames 306 connecting opposite ends of the lower horizontal frame 302 to corresponding opposite ends of the upper horizontal frame 305. When the folding container is assembled and the short side walls 300 are stood up perpendicularly to the bottom portion 100, an inner surface 301*a* of the plate section 301 is substantially flush with the inner surface of the plate section 106*a* of each hinge male section 106 formed on the bottom portion 100. When the folding container is assembled, no projecting portion is formed on a short-side-wall-300-side inner surface of the folding container. Additionally, when the folding container is assembled, the lower horizontal frame 302, the upper horizontal frame 305, and the vertical frame 306, and the like do not project outward beyond the short side portion 102 of the bottom portion 100.

The short side wall 300 has vertically elongated recesses 307 each having an open underside and formed therein by folding the lower horizontal frame 302 upward. The recesses 307 are configured so that when the folding container is assembled and the short side wall 300 is stood up perpendicularly to the bottom portion 100, the short-side locking blocks 113 formed on the bottom portion 100 can slide into the corresponding recesses 307 without interfering with the short side wall 300.

An engagement frame section 308 is formed outside each of the vertical frames 306 of the short side wall 300. A plate section 308' of the engagement frame section 308 which is formed as an extension of the plate section 301 has a generally prismatic upper fitting projection 308*a* projecting outward and having a tapered tip and which can be fitted in the upper fitting through-hole 207*a* drilled in the engagement frame section 207 formed at a corresponding one of the opposite ends of the long side wall 200. In addition, a pair of locking pieces 308*b* extend below the upper fitting projection 308*a* in a generally horizontal direction and each have a locking projection 308*b*' in a manner such that the projections 308*b*' are mutually opposed. The swollen portion 207*d*' of each of the engagement projections 207*d* formed on the long side wall 200 is inserted between the pair of locking pieces 308*b*, and tip portions of the locking pieces 308*b* are inserted into the through-holes 207*b*, 207*c* drilled above and below the engagement projection 207*d*. Then, the locking projections 308*b*' of the locking pieces 308*b* formed on the engagement frame section 308 of the short side wall 300 are engagingly locked on a rear surface of the swollen portion 207*d*' of the engagement projection 207*d* formed on the engagement frame section 207 of the long side wall 200.

Furthermore, an intermediate fitting projection 308*c* is formed below the locking piece 308*b* in a fashion extending outward and perpendicularly from the vertical frame 306 and is configured to fit in the fitting recess 207*e* formed in each of the engagement frame sections 207 of the long side wall 200. In addition, a flat lower engagement projection 308*d* is formed below the intermediate fitting recess 308*c*, and is configured to fit in the lower fitting through-hole 207*g* in each of the engagement frame sections 207 of the long side wall 200. A box-shaped lower fitting projection 308*e* is formed below the lower engagement projection 308*d* so as to be inserted into a gap D between the lower end of each engagement frame section 207 of the long side wall 200 and the upper end of the fitting section 112 formed at a corresponding one of the opposite ends of the corresponding short side portion 102 of the bottom portion 100 when the folding container is assembled. Furthermore, the engagement frame section 308 has a lower-end engagement projection 308f formed at a lower end thereof and configured to fit in the through-hole 112*a* in the fitting section 112 formed at each of the opposite ends of the short side portion 102 of the bottom portion 100, 309 is a hand-held opening formed above the short side wall 300 and into which the operator's fingers can be inserted.

A gap is formed between each of the above described vertical walls 111 of the bottom portion 100 and the above described hook 106*b* of each hinge female section 106 formed on the bottom portion 100 and has an interval smaller than the diameter of the horizontal pin 303*b* of each hinge male section 303 formed on the short side wall 300.

Next, how to assemble together the bottom portion 100, long side walls 200, and short side walls 300 configured as described above will be described.

The long side wall 200 is lowered to forcibly insert the horizontal pins 203*b* of the hinge male sections 203 formed on the long side wall 200 into the gap formed between the corresponding end wall 105 of the bottom portion 100 and the hooks 106*b* of the hinge female sections 106 formed on the bottom portion 100. Then, the plate pieces 106*a* of the hinge female sections 106 of the bottom portion 100 are slantly moved inward to create a gap between the end wall, 105 of the bottom portion 100 and the hooks 106*b* of the hinge female sections 106 through which the horizontal pins 203*b* of the hinge male sections 203 of the long side wall 200 pass. The horizontal pins 203*b* are pushed downward to below the corresponding hooks 106*b* of the hinge female sections 106 of the bottom portion 100. Then, the plate pieces 106*a* of the hinge female sections 106 of the bottom portion 100 return to their original positions due to their elastic force to cause the horizontal pins 203*b* of the hinge male sections 203 of the long side wall 200 to fit in the recesses 106*b*' of the hooks 106*b* of the hinge female sections 106 of the bottom portion 100. Thus, the hinge female sections 106 formed on the bottom portion 100 and the hinge male sections 203 formed on the long side wall 200 hinge the bottom portion 100 to the long side wall 200. Likewise, the hinge female sections 106 formed on the short-side-portion-102 side of the bottom portion 100 and the hinge male sections 303 formed on the short side wall 300 are coupled together to connect the bottom portion 100 and the short side wall 200 together.

When the folding container folded as shown in FIG. 3 is assembled as shown in FIG. 1, the long side walls 200, overlapping the bottom portion 100 and the short side walls 300, are stood up perpendicularly and the short side walls 300 are then stood up perpendicularly to assemble the folding container in the form of a box. The long side walls 200 and the short side walls 300 are configured so that each engagement frame section 207 formed on the long side wall 200 and the corresponding engagement frame section 308 formed on the short side wall 300 are mutually engaged to preclude the short side walls 300 of the assembled folding container from falling down inward easily.

As described above, when the short side wall 300 is rotatively moved in the vertical direction relative to the long side wall 200 stood up perpendicularly, the lower-end engagement projection 308*f* formed on each engagement frame section 308 of the short side wall 300 is first fitted in the through-hole 112*a* in the fitting section 112 formed at a corresponding one of the opposite ends of the short side portion 102 of the bottom portion 100. Then, the lower-end fitting projection 308*e* of the engagement frame section 308 of the short side wall 300 is inserted between the gap D formed between the lower end of each engagement frame section 207 on the long side wall 200 side and the upper end of the fitting section 112 formed at a corresponding one of the opposite ends of the short side portion 102 of the bottom portion 100. In addition, the lower engagement projection 308*d* of the engagement frame section 308 of the short side wall 300 is fitted in the lower fitting through-hole 207*g* in the engagement frame section 207 of the long side wall 200. Further, the intermediate fitting projection 308*c* of the engagement frame section 308 of the short side wall 300 is fitted in the fitting recess 207*e* of the engagement frame section 207 of the long side wall 200. Furthermore, the locking projections 308*b*' of the pair of locking pieces 308*b* of the engagement frame section 308 of the short side wall 300 are engagingly locked on the rear surface of the swollen portion 207*d*' of the engagement projection 207*d* formed on the engagement frame section 207 of the long side wall 200. Finally, the upper fitting projection 308*a* of the engagement frame section 308 of the short side wall 300 is fitted in the upper fitting through-hole 207*a* in the engagement frame section 207 of the long side wall 200, so that the engagement frame section 207 formed in the long side wall 200 and the corresponding engagement frame section 308 formed in the short side wall 300 are mutually engaged reliably.

As described above, when the short side wall 300 is rotatively moved in the vertical direction relative to the long side wall 200 stood up perpendicularly, the lower-end engagement projection 308*f* formed on each engagement frame section 308 of the short side wall 300 is first fitted in the through-hole 112*a* in the fitting section 112 formed at a corresponding one of the opposite ends of the short side portion 102 of the bottom portion 100. Then, the flat lower engagement projection 308*d* of the engagement frame section 308 on the short side wall 300 side is fitted in the lower fitting through-hole 207*g* in the engagement frame section 207 of the long side wall 200. Consequently, the lateral (a direction in which the short side wall 300 moves in the vertical direction relative to the plate section 201 of the long side wall 200) movement of the short side wall 300 relative to the long side wall 200 is regulated to prevent the position of the engagement frame section 308 of the short side wall 300 from moving relative to the plate section 201 of the long side wall 200, thereby enabling smooth and reliable engagement between the engagement frame section 308 of the short side wall 300 and the engagement frame section 207 of the long side wall 200.

Furthermore, the engagement frame section 308 of the short side wall 300 has the generally prismatic upper fitting projection 308*a* having the tapered tip and configured so that in a final stage of the engagement between the engagement frame section 308 of the short side wall 300 and the engagement frame section 207 of the long side wall 200, the upper fitting projection 308*a* is fitted in the upper fitting through-hole 207*a* formed in the engagement frame section 207 on the long side wall 200 in a manner such that an outer peripheral surface of the upper fitting projection 308*a* is located close to an inner peripheral surface of the upper fitting through-hole 207*a*. Accordingly, the vertical movement of the short side wall 300 relative to the long side wall 200 and the movement of the short side wall 300 away from the long side wall 200 are regulated to preclude the long side walls 200 and the short side walls 300 from being wobbly in the assembled folding container. As a result, assembled folding containers, when piled up, are prevented from tottering and can be stably stacked up.

As described above, the lower-end engagement projection 308*f* of each engagement frame section 308 of the short side wall 300 is fitted in the through-hole 112*a* in the fitting section 112 formed at a corresponding one of the opposite ends of the short side portion 102 of the bottom portion 100, thereby allowing the bottom portion 100 and the short side walls 300 to be coupled more strongly to regulate the movement of the short side walls 300 relative to the bottom portion 100. This configuration can prevent substantial movement of the short side wall 300 relative to the bottom portion 100, which may cause damage to the hinge female sections 106 formed on the bottom portion 100 or to the hinge male sections 303 formed on the short side wall 300, the hinge female and male sections constituting the hinging coupling the bottom portion 100 and the short side walls 300 together. In addition, the lower-end engagement projection 308*f* of the engagement frame section 308 of the short side wall 300 and the through-hole 112*a* in the fitting section 112 formed at the corresponding one of the opposite ends of the short side portion 102 of the bottom portion 100 provide a kind of positioning function to enable smooth and reliable coupling between the bottom portion 100 and the short side walls 300.

Additionally, the lower-end engagement projection 308*f* of the engagement frame section 308 of the short side wall 300 is fitted in the through-hole 112*a* in the fitting section 112 formed at the corresponding one of the opposite ends of the short side portion 102 of the bottom portion 100, thereby allowing the bottom portion 100 and the short side walls 300 to be coupled more strongly, and the long side walls 200 and the short side walls 300 are also firmly coupled together by means of a plurality of fitting means and engagement means, that is, the fitting of the lower engagement projection 308*d* formed on the engagement frame section 308 of the short side wall 300, in the lower fitting through-hole 207*g* drilled in the engagement frame section 207 of the long side wall 200, the fitting of the intermediate fitting projection 308*c* formed on the engagement frame section 309 of the short side wall 300, in the fitting recess 207*e* formed in the engagement frame section 207 of the long side wall 200, the engagingly locking of the locking projections 308*b*' of the pair of locking pieces 308*b* formed on the engagement frame section 308 of the short side wall 300, on the swollen portion 207*d*' of the engagement projection 207*d* formed on the engagement frame section 207 of the long side wall 200, and the fitting of the upper fitting projection 308*a* formed on the engagement frame section 308 of the short side wall 300, in the upper fitting through-hole 207*a* drilled in the engagement frame section 207 of the long side wall 200. As a result, the long side walls 200 and the short side walls 300 are unlikely to be mutually disengaged to improve the strength of the assembled folding container. Additionally, when a large number of assembled folding containers are piled up, the long side walls 200 and the short side walls 300 are prevented from moving to enable stable pile-up, that is, stack-up.

Furthermore, when the folding container is assembled, the lower fitting projection 308*e* formed on the engagement frame section 308 of the short side wall 300 is inserted, in a sandwich fashion, into the gap D between the lower end of each engagement frame section 207 of the long side wall 200 and the upper end of the fitting section 112 formed at the corresponding one of the opposite ends of the short side portion 102 of the bottom portion 100. Consequently, even if a load is imposed on the short side wall 300 of the assembled folding w container from above, it is shared by the lower fitting projection 308*e* of the short side wall 300, which is placed at the upper end of the fitting section 112 formed at the corresponding one of the opposite ends of the short side portion 102 of the bottom portion 100. Therefore, the hinging coupling the bottom portion 100 and the short side walls 300 together is not subjected to the load, thereby preventing damage to the hinge female sections 106 formed on the bottom portion 100 and to the hinge male sections 303 formed on the short side wall 300.

In addition, the engagement frame section 308 of the short side wall 300 has the pair of locking pieces 308*b* each extending substantially in the horizontal direction and having the locking projection 308*b*' at its tip, and the pair of locking pieces 308*b* engagingly lock the rear surface of the swollen portion 207*d*' of the engagement projection 207*d* formed on the engagement frame section 207 on the long side wall 200 side. Accordingly, even if the long side wall 200 or the short side wall 300 wobbles in the vertical direction, since one of the locking pieces 308*b* is locked on the engagement projection 207*d*, the locking pieces 308*b* and the engagement projection 207*d* are not mutually unlocked. Additionally, even if the long side wall 200 or the short side wall 300 moves in the horizontal direction, the locking pieces 308*b* are not disengaged from the engagement projection 207*d* because they are laterally elongated so as to extend in the horizontal direction, resulting in a firm engagement between the engagement frame section 207 of the long side wall 200 and the engagement frame section 308 of the short side wall 300. Furthermore, the intermediate fitting projection 308*c* formed on the engagement frame section 308 of the short side wall 300 is fitted in the fitting recess 207*e* formed in the engagement frame section 207 of the long side wall 200. This configuration restrains wobbling and relative movement between the long side wall 200 and the short side wall 300, thereby more reliably preventing disengagement between the locking pieces 308*b* and the engagement projection 207*d*.

As described above, when the folding container is assembled, each long-side locking block 108 formed on the bottom portion 100 slides into the corresponding recess 210 having the open underside and formed in the lower horizontal frame 202 of the long side wall 200, and each short-side locking block 113 formed on the bottom portion 100 slides into the corresponding vertically elongated recess 307 formed in the short side wall 300. In this manner, when the folding container is assembled, the long-side locking blocks 108 and short-side locking blocks 113 formed on the bottom portion 100 do not abut on the long side wall 200 and the short side wall 300, respectively. In addition, when the folding container is assembled, each end locking block 109 formed on the bottom portion 100 can slide into the notch 209 without interfering with the long side wall 200, the notch 209 being located at the corresponding one of the lower opposite ends of the long side wall 200 and formed of the horizontal frame 208 higher than the lower horizontal frame 202 and the vertical piece 203*a* of the corresponding hinge male section 203.

As described above, the outer surface 108*a* of each long-side locking block 108, the outer surface 113*c* of each short-side locking block 113, and the outer surface 109*c* of each end locking block 109, which are all formed on the bottom portion 100, are configured so as not to project outward beyond the corresponding long side portion 101 and short side portion 102 of the bottom portion 100. Additionally, the long side wall 200 and the short side wall 300 are configured so as not to project outward beyond the corresponding long side portion 101 and short side portion 102 of the bottom portion 100. Furthermore, the outer surfaces of the bottom portion 100, long side walls 200, and short side walls 300 are configured to be substantially mutually flush. Consequently, even when two assembled folding containers are arranged in juxtaposition in a manner such that the long side wall 200 or short side wall 300 of one of the folding containers are brought in abutment with the corresponding long side wall 200 or short side wall 300 of the other, substantially no gap is formed between the adjacent folding containers, thereby allowing the assembled folding containers to be stored more efficiently. In addition, since no fitting shoulder section is formed as in the conventional folding containers, the folding container according to the present invention, when assembled, has a large internal volume compared to its outside dimensions, and thus has an improved accommodation efficiency.

If the folding container assembled as shown in FIG. 1 is folded as shown in FIG. 3, the short side walls 300 are rotatively moved toward the bottom portion 100 to disengage the engagement frame sections 207 of the long side walls 200 from the engagement frame sections 308 of the short side walls 300 to place the short side walls 300 on the bottom portion 100. Then, the long side walls 200 are brought down and placed on the folded short side walls 300, and in this case, since the short-side locking blocks 113 formed on the bottom portion 100 have slid into the corresponding fitting recesses 207*e* formed in the engagement frame section 207 of the long side wall 200 and then into the corresponding fitting through-holes 207*f* drilled in the long side wall 200, the short-side locking blocks 113 formed on the bottom portion 100 do not obstruct the folding of the long side walls 200. In this manner, the folding container is folded. Then, the long-side locking blocks 108, end locking blocks 109, and short-side locking blocks 113 formed on the bottom portion 100 project upward above the long side walls 200 of the folded folding container.

In addition, since the short-side locking blocks 113 are each configured to be inserted into the corresponding fitting through-hole 207*f* drilled in the long side wall 200, even if an external or internal force is applied to the short-side locking block 113, the fitting through-hole 207*f* serves to prevent the short-side locking block 113 from being shifted or damaged, thereby enabling folded folding containers to be stably stacked up. In this manner, the folding container is folded. Preferably, a trumpet-shaped inclined surface 207*e*' is formed at a tip portion of the fitting recess 207*e* so that the short side locking block 113, when inserted into the fitting through-hole 207, does not abut on portions of the engagement frame section 207 above and below the fitting recess 207*e*. Additionally, the inclined surface 207*e*' works as a guide surface when the short-side locking block 113 is inserted into the fitting through-hole 207*f*.

When folding containers folded as shown in FIG. 3 are stacked up, the bottom fitting section 100*a* formed of the inner wall 104*b* and the like of the bottom section 100 of the upper folding container is fitted on the notches 108*d* in the long-side locking blocks 108, the notches 113*b* in the short-side locking blocks 113, and the projecting portions 109*b* of the end locking blocks 109, which are all formed on the bottom portion 100 of the lower folding container, and the bottom fitting section 100*a* is placed on the placement surfaces 108*c* of the long-side locking blocks 108, the placement surfaces 113*a* of the short-side locking blocks 113, and the placement surfaces 109*a* of the end locking blocks 109. Consequently, the upper folding container is prevented from moving in the horizontal direction by means of the long-side locking blocks 108, short-side locking blocks 113, and end locking blocks 109 of the lower folding container, thereby enabling a large number of folded folding containers to be stably stacked up.

The arrangement, number, and the like of the long-side locking blocks 108, end locking blocks 109, and short-side locking blocks 113 formed on the bottom portion 100 in the above described embodiment are not limited to those in this embodiment.

In addition, if the bottom portion 100 has the long-side locking blocks 108 and the short-side locking blocks 113 formed thereon and when the folded folding containers are stacked up, the bottom fitting section 110*a* of the bottom portion 100 of the upper folding container is fitted on the notches 108*d* in the long-side locking blocks 108 and the notches 113*b* in the short-side locking blocks 113, which are all formed on the bottom portion 100 of the lower folding container, thereby hindering the upper folding container from moving in the horizontal direction. Accordingly, the end locking blocks 109 can be omitted.

Furthermore, since the end locking blocks 109 each have the projecting portion 109*b* having a generally L-shaped planar shape and comprising the projecting sub-portion 109*b*' extending along the long side portion 101 and the projecting sub-portion 109*b*" extending perpendicularly to the long side portion 101, folded folding containers can also be stably stacked up by using only the end locking blocks 109 without forming the long-side locking blocks 108 or the short-side locking blocks 113.

Figure 14:
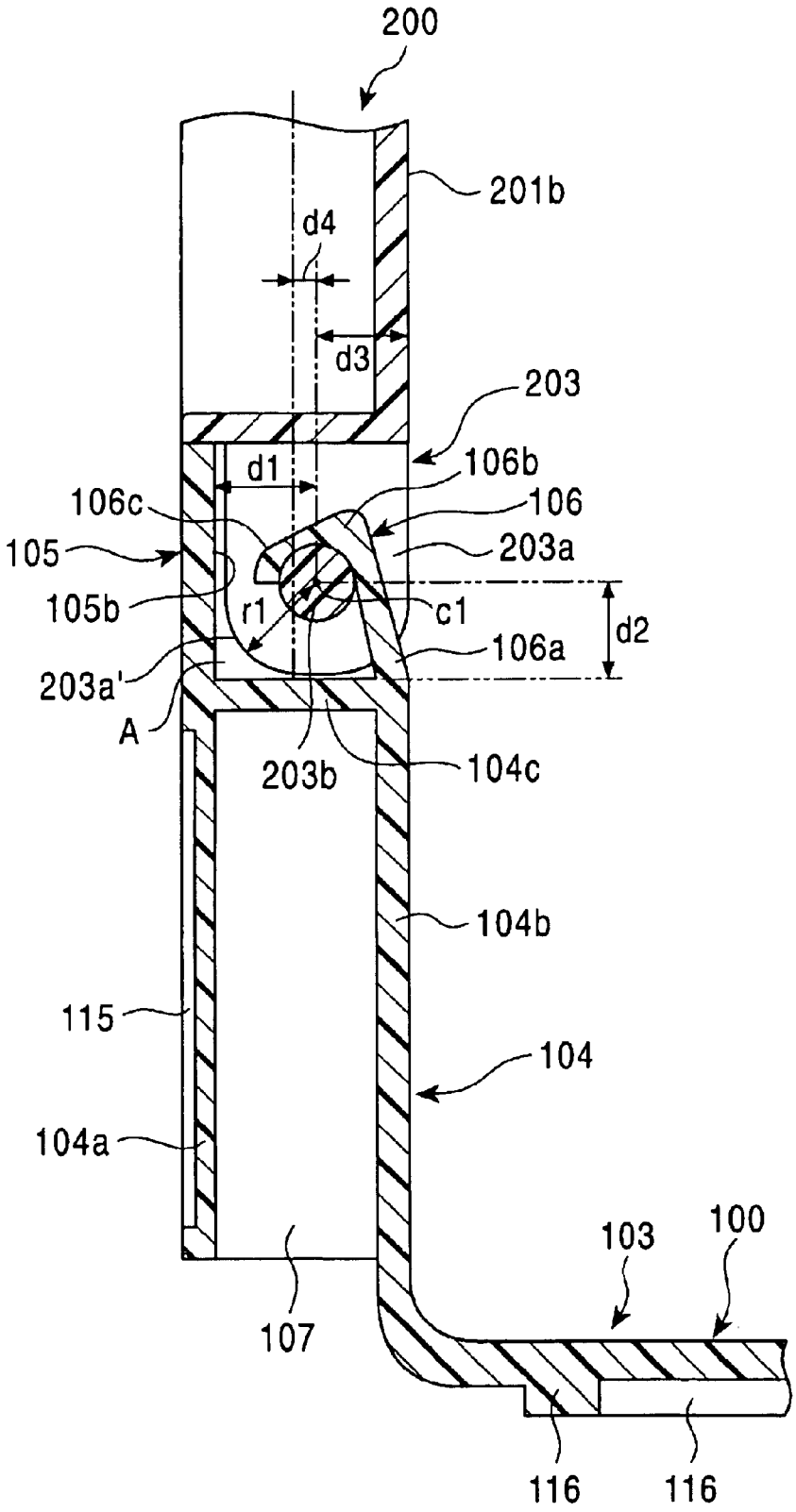
FIG. 14 is a vertical sectional view including the bottom portion and a hinge section of the long side wall of the folding container according to the present invention.

Next, the hinge male sections 203 formed on each long side wall 200 and the hinge female sections 106 formed on each long side portion 101 of the bottom portion 100, which are all shown as examples of components constituting the hinging, will be described in detail with reference to FIGS. 14 and 15.

This embodiment substantially eliminates the gap as conventionally formed between the lower end of the vertical piece 203*a* of each hinge male section 203 disposed on the long side wall 200 and the top surface of the horizontal wall 104*c* of the corresponding double wall section 104 of the bottom portion 100.

Thus, when the folding container is assembled, a radius r1 located in a corner A formed of an inner surface 105*b* of each end wall 105 of the bottom portion 100 and of the horizontal wall 104*c* of each double wall 104 of the bottom portion 100, the radius covering almost a quarter of the vertical piece 203*a* of each hinge male section 203 disposed on the long side wall 200, a distance d1 between a central point c1 of the horizontal pin 203*b* of the hinge male section 203 and the inner surface 105*b* of the end wall 105, and a distance d2 between the central point c1 of the horizontal pin 203*b* and the top surface of the horizontal wall 104*c* of the double wall section 104 are almost equal, and a distance d3 between the central point c1 of the horizontal pin 203*b* and the inner surface 201*b* of each plate section 201 of the long side wall 200 and a distance d2 between the central point c1 of the horizontal pin 203*b* and the top surface of the horizontal wall 104*c* of the double wall section 104 are almost equal. To achieve this configuration, the central point c1 of the horizontal pin 203*b* of the hinge male section 203 formed on the long side wall 200 is offset, by a predetermined amount d4, from a thickness-wise center line L1 of the long side wall 200 toward the inner surface 201*b* of the plate section 201 of the long side wall. 200, that is, in the direction in which the long side wall 200 is rotated.

In short, the distance d1 between the central point c1 of the horizontal pin 203*b* of the hinge male section 203 formed on the long side wall 200 and the inner surface 105*b* of the end wall 105 of the bottom portion 100, the distance d2 between the central point c1 of the horizontal pin 203*b* and the top surface of the horizontal wall 104*c* of the double wall section 104 of the bottom portion 100, and the distance d3 between the central point c1 of the horizontal pin 203*b* and the inner surface 201*b* of the plate section 201 of the long side wall 200 are all almost equal to the radius r1 of the generally semicircular portion 203*a*' in the lower part of the vertical piece 203*a* constituting the hinge male section 203 formed on the long side wall 200. This configuration substantially eliminates the gap between the lower end of the vertical piece 203*a* of the hinge male section 203 formed on the long side wall 200 and the top surface of the horizontal wall 104*c* of the double wall section 104 of the bottom portion 100 to prevent foreign matter from entering this gap while enabling the long side wall 200 to be brought down to its substantially horizontal position in folding the folding container.

With this configuration, when the folding container is assembled as shown in FIG. 1, substantially no gap is formed between the lower end of the vertical piece 203*a* of the hinge male section 203 formed on the long side wall 200 and the top surface of the horizontal wall 104*c* of the double wall section 104 of the bottom portion 100 to prevent foreign matter such as articles accommodated in the folding container or dust from entering this gap.

In addition, the distance d3 between the central point c1 of the horizontal pin 203*b* and the inner surface 201*b* of the plate section 201 of the long side wall 200 is almost equal to the distance d2 between the central point c1 of the horizontal pin 203*b* and the top surface of the horizontal wall 104*c* of the double wall section 104 of the bottom portion 100, so that when the folding container is folded as shown in FIG. 2, the long side walls 200 can be brought down to their substantially horizontal positions and are thus prevented from inclining upward relative to the central point c1 of the horizontal pin 203*b*, thereby enabling the folding container to be folded thin.

In addition, the hook 106*b* of each hinge female section 106 has an inclined surface 106*c* formed on an upper outer peripheral surface thereof and inclining upward from the corresponding end wall 105 of the bottom portion 100 toward the plate piece 106*a* of the hinge female section 106. To hinge the bottom portion 100 to the long side wall 200, the inclined surface 106*c* has such a width that when the long side wall 200 is lowered, the horizontal pin 203*b* of each hinge male section 203 formed on the long side wall 200 is placed on the inclined surface 106*c* as shown in FIG. 15.

Figure 15:
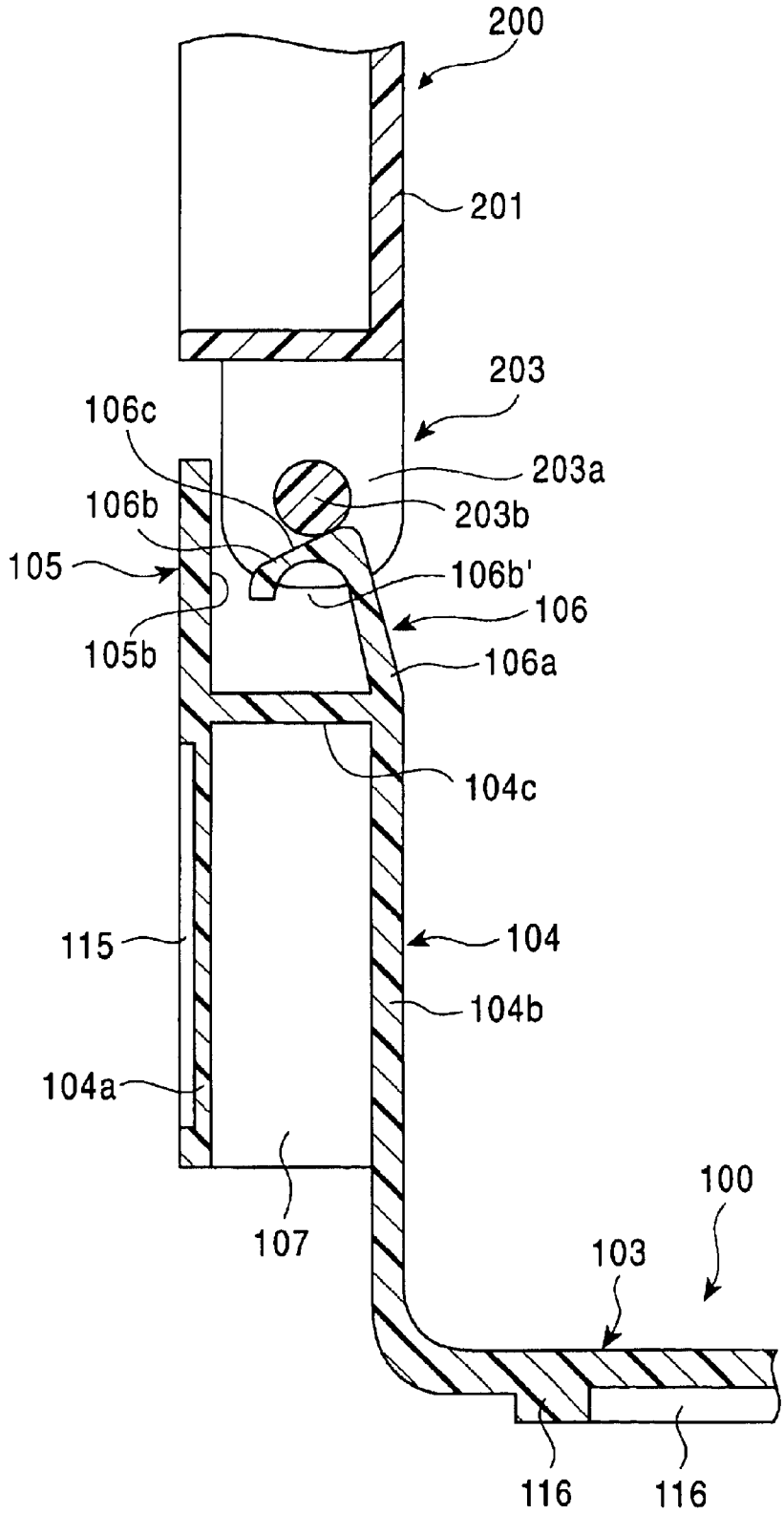
FIG. 15 is a vertical sectional view including the bottom portion and the hinge section of the long side wall of the folding container according to the present invention immediately before the bottom portion and the hinge section are coupled together.

To hinge the bottom portion 100 to the long side wall 200, the long side wall 200 is first lowered so that the horizontal pin 230*b* of each hinge male section 203 formed on the long side wall 200 comes in abutment with the inclined surface 106*c* of the hook 106*b* of the corresponding hinge female section 106 formed on the bottom portion 100, as shown in FIG. 15. Subsequently, when the long side wall 200 is further lowered, the horizontal pin 203*b* moves along the inclined surface 106*c* of the hook 106*b* toward the end wall 105. After the horizontal pin 203*b* of the hinge male section 203 formed on the long side wall 200 has come in abutment with the end wall 105 and when the long side wall 200 is further lowered, the hinge female section 106 slantly moves to the right in FIG. 15 against its own elastic force to form a gap between the end wall 105 and the tip of the hook 106*b* through which the horizontal pin 203*b* can pass. Once the horizontal pin 203*b* has moved downward below the tip of the hook 106*b* of the hinge female section 106 after passing through the above gap, the hinge female section 106 returns to its original position due to its elastic force, and the horizontal pin 203*b* of the hinge male section 203 is fitted in the recess 106*b*' of the hook 116*b* of the hinge female section 106, thereby hinging the bottom portion 100 to the long side wall 200 via the hinge section comprising the hinge female sections 106 and the hinge male sections 203.

As described above, the hook 106*b* of each hinge female section 106 has the inclined surface 106*c* formed on the upper outer peripheral surface thereof and inclining downward to the corresponding end wall 105 of the bottom portion 100 so that when the long side wall 200 is lowered, the horizontal pin 203*b* of the corresponding hinge male section 203 formed on the long side wall 200 is placed on the inclined surface 106*c*, whereby the horizontal pin 203*b* of the hinge male section 203 formed on the long side wall 200 is prevented from moving toward the plate piece 106*a* of the hinge female section 106 formed on the bottom portion 100. Consequently, the horizontal pin of the hinge male section is not fitted in the recess in the hook of the hinge female section as in the prior art, thereby preventing failures to hinge the bottom portion to the long side wall.

Next, a card holder 400 molded integrally with the log side wall 200 will be explained by way of example with reference to FIGS. 8 and 16 to 19. The card holder 400 is constructed by juxtaposing two or more card holder members 400*a* each formed of a card presser piece 401 and the like, described below. One of the card holder members 400*a* constituting the card holder 400 will be described below.

The card presser piece 401 constituting the card holder member 400*a* is connected to a thin connection section 402 connected to a lower end of a connection wall 204*b* formed between the vertical piece 203*a* of the hinge male section 203 formed on the bottom surface of the lower horizontal frame 202 of the long side wall 200 and the vertical piece 204*a* of the lower block 204. The card presser piece 401 is formed into an elongated band.

Figure 16:
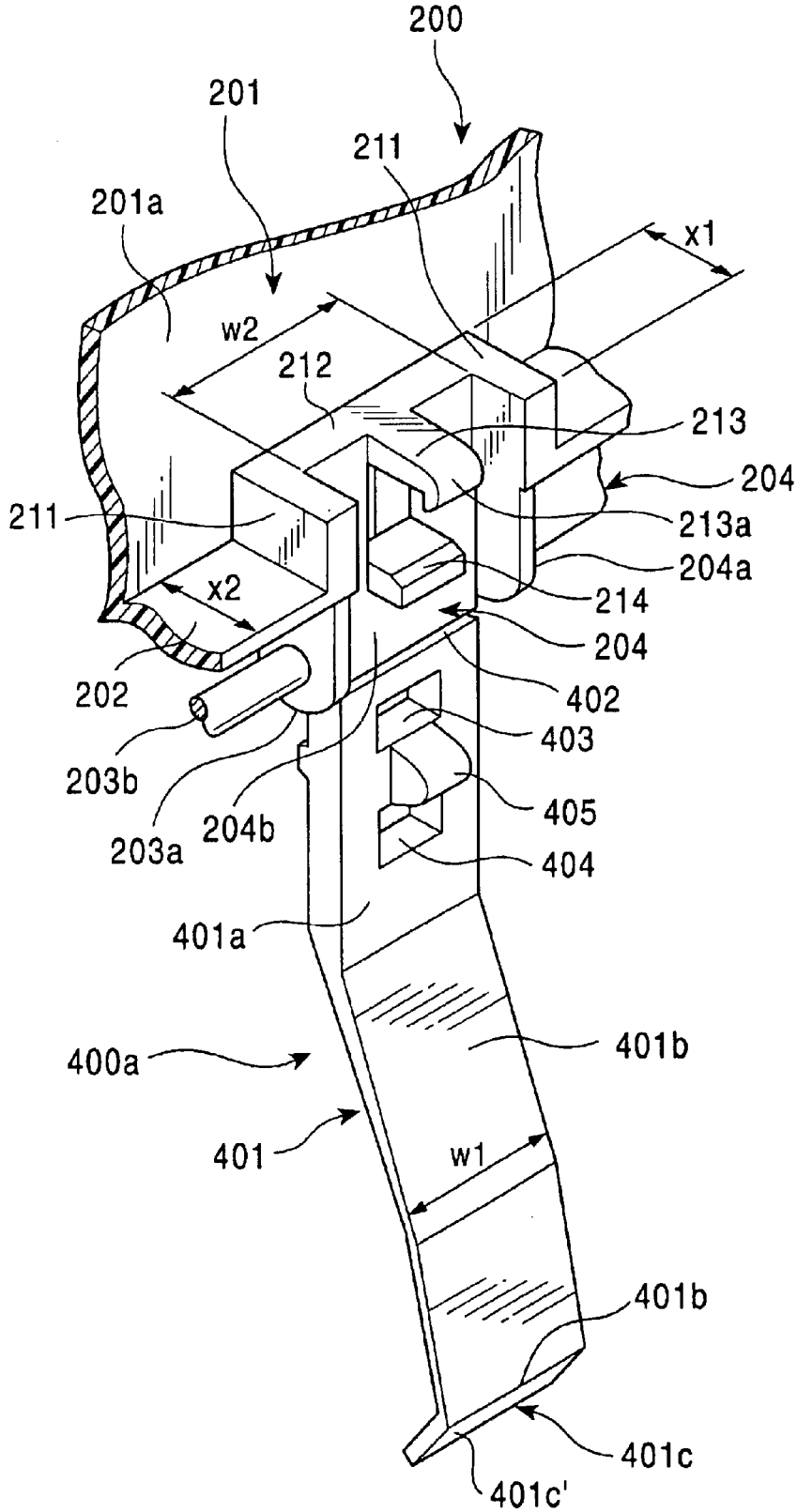
FIG. 16 is an enlarged perspective view showing a card holder before assembly, the card holder being disposed on the long side wall of the folding container according to the present invention.
Figure 17:
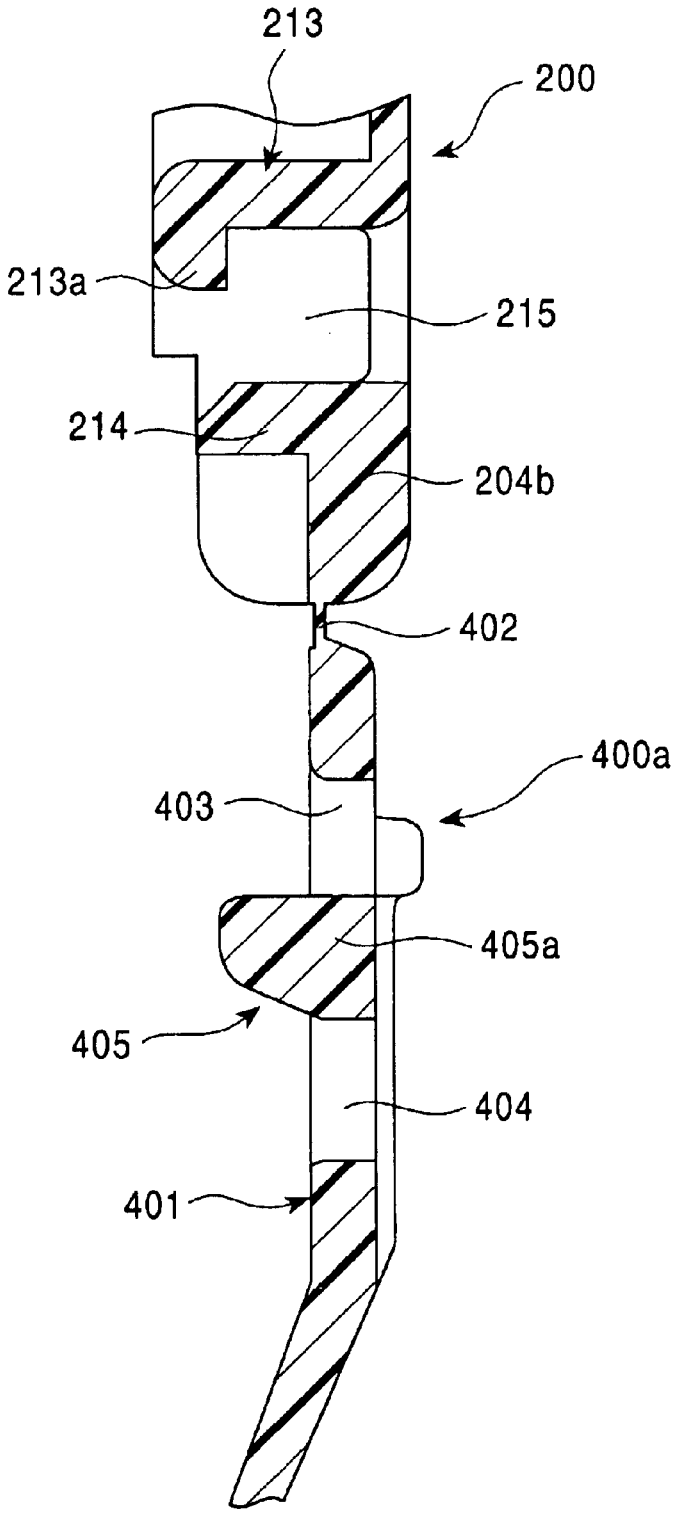
FIG. 17 is a vertical sectional view showing the card holder before assembly, the card holder being disposed on the long side wall of the folding container according to the present invention.
Figure 18:
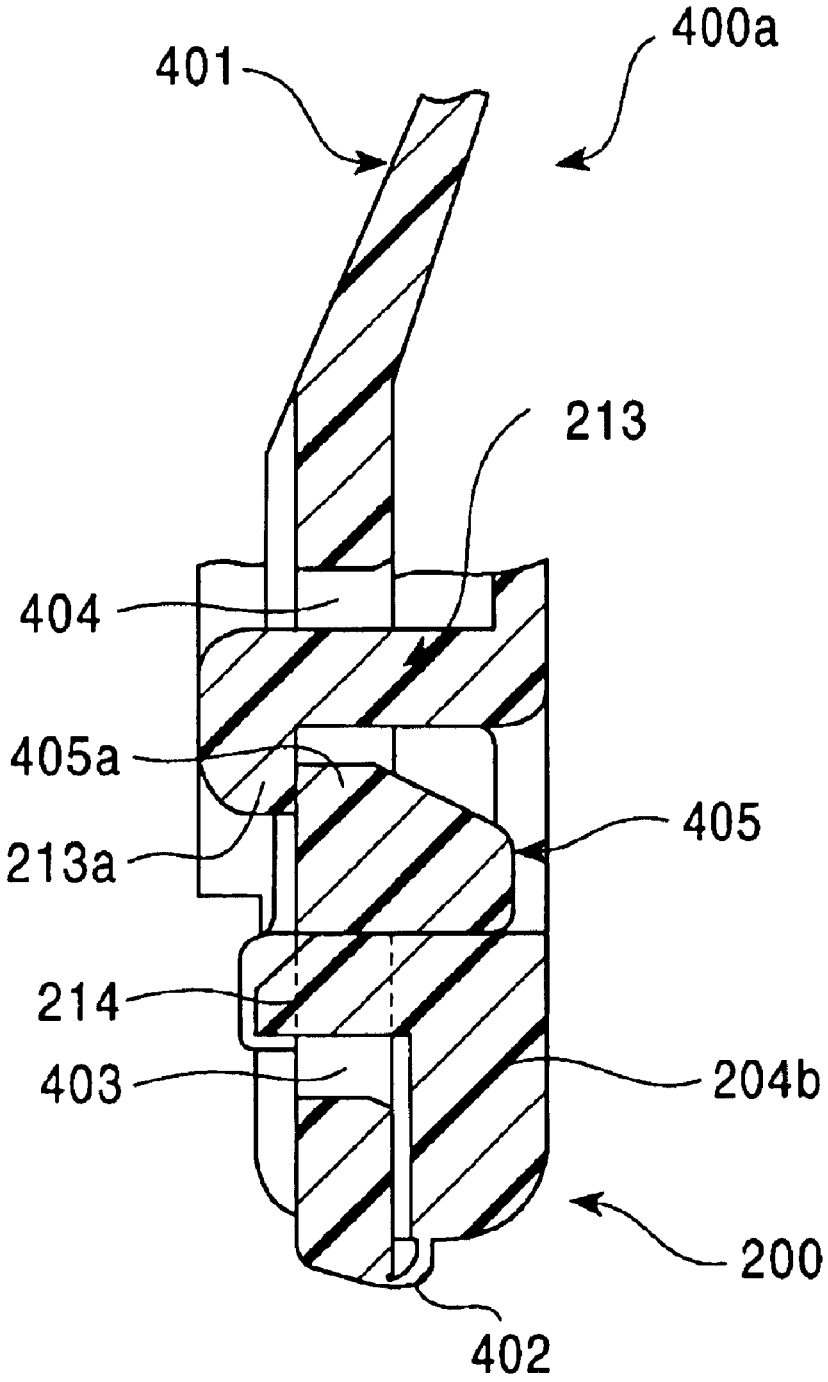
FIG. 18 is a fragmentary vertical sectional view showing the card holder after assembly, the card holder being disposed on the long side wall of the folding container according to the present invention.
Figure 19:
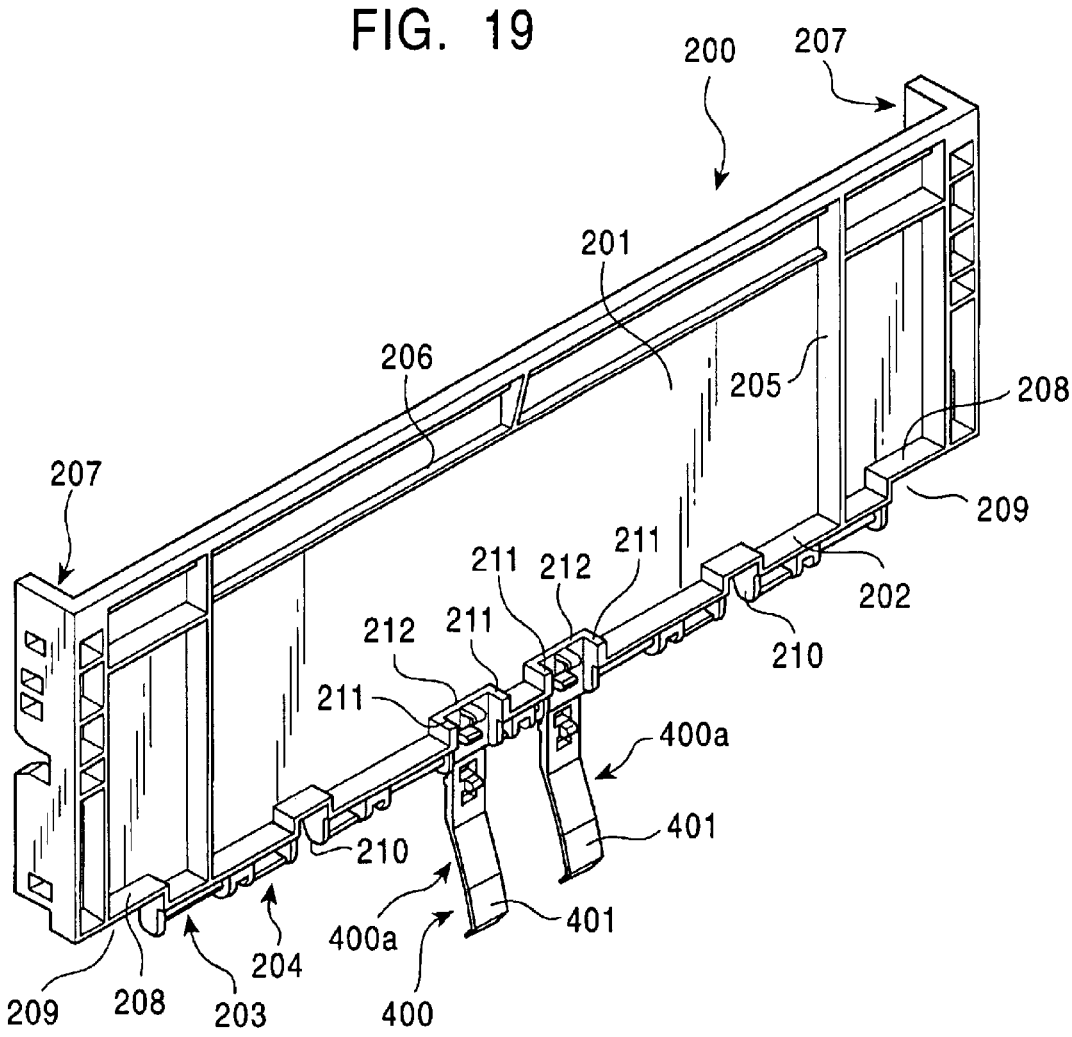
FIG. 19 is a perspective view of the long side wall of the folding container according to the present invention with the card holders disposed thereon.

When the card holder member 400*a* is molded integrally with the long side wall 200, the card presser piece 401 suspends generally downward perpendicularly from the lower end of the long side wall 200 via the thin connection section 402, as shown in FIGS. 16 and 19. The card presser piece 401 has a first fitting hole 403 drilled near the thin connection section 402 and a second fitting hole 404 drilled further from the thin connection section 402 than the first fitting hole 403. In addition, an engagement projection 405 is formed between the first fitting hole 403 and the second fitting hole 404 in the card presser piece 401 so as to extend away from the outer surface 201*a* of the plate section 201 of the long side wall 200.

211 is a pair of regulation blocks disposed on the lower horizontal frame 202 of the long side wall 200 so as to have an internal width w2 slightly larger than the width w1 of the card presser piece 401. The regulation block 211 has a depth x1 formed to be almost the same as the depth x2 of the lower horizontal frame 202 of the long side wall 200. Additionally, the regulation blocks 211 are connected together by a connection block 212 integrated with the plate section 201 of the long side wall 200.

The connection block 212 has a locking piece 213 formed in a substantially central portion in its upper part so as to extend in the horizontal direction away from the outer surface 201*a* of the plate section 201 of the long side wall 200, and the locking piece 213 has a locking projection 213*a* formed on a bottom surface thereof at its tip so as to extend downward. A guide block 214 is formed below the locking piece 213 and extends in the same direction as the locking piece 213 substantially parallel therewith. 215 is a through-hole formed between the locking piece 213 and the guide block 214 by means of a molding member for molding the card holder member 400*a* integrally with the long side wall 200.

As described above, when the card holder member 400*a* is molded integrally with the long side wall 200, the card presser piece 401 suspends generally downward perpendicularly from the lower end of the long side wall 200 via the thin connection section 402. When, however, the card presser piece 401 is then rotatively moved toward the outer surface 201*a* of the plate section 201 of the long side wall 200 in a fashion folding the thin connection section 402, the guide block 214 formed on the long side wall 200 is first fitted in the first fitting hole 403 formed in the card presser piece 401. When the card presser piece 401 is continuously rotatively moved toward the outer surface 201*a* of the plate section 201 of the long side wall 200, the engagement projection 405 formed on the card presser piece 401 is pushed into the gap between the guide block 214 and the locking piece 213 formed on the long side wall 200, and is then passed therethrough while elastically deforming the locking piece 213 upward to extend the gap between the guide block 214 and the locking piece 213.

After the engagement projection 405 formed on the card presser piece 401 has passed through the gap between the guide block 214 and the locking piece 213 formed on the long side wall 200, the locking piece 213 is rotatively moved downward due to its own elasticity and its locking projection 213*a* is engagingly locked on an upper corner 405*a* at a tip of the engagement projection 405, so that the card presser piece 401 is engaged with and held in the locking piece 213 formed on the long side wall 200.

Additionally, the card presser piece 401 is formed of a base 401*a* located on the thin connection section 402 side and having the first fitting hole 403, the second fitting hole 404, and the engagement projection 405 formed therein; an intermediate portion 401*b* connected to the base 401*a* and inclined outward; and a card guide section 401c formed by bending a tip of the intermediate portion 401*b* outward. Once the upper corner 405*a* at the tip of the engagement projection 405 formed on the card presser piece 401 has been engagingly locked in the locking projection 213*a* of the locking piece 213 formed on the long side wall 200 to assemble the card holder member 400*a*, a bent portion 401*d* located at the boundary line between the intermediate portion 401*b* of the card presser piece 401 and the card guide section 401*c* comes in abutment with the outer surface 201*a* of the plate section 201 of the long sidewall 200. Additionally, a wedge-shaped space 406 is formed between an inner surface 401*c*' of the card guide section 401*c* located above the bent portion 401*d* and the outer surface 201*a* of the plate section 201 of the long side wall 200 in a manner such that the interval between the inner surface 401*c*' of the card guide section 401*c* and the outer surface 201*a* of the plate section 201 of the long side wall 200 decreases linearly with height.

By assembling two or more card holder members 400*a* as described above, the card holder 400 is formed. To allow the card holder 400 formed in this manner to hold a card 407, a lower side 407*a* of the card 407 is inserted into the above described wedge-shaped space 406 and the card 407 is then pushed downward. The card 407 moves the bent portion 401*d* of the card presser piece 401, with which the outer surface 201*a* of the plate section 201 of the long side wall 200 is in abutment, away from the outer surface 201*a* of the plate section 201 of the long side wall 200, to form a gap between the outer surface 201*a* of the plate section 201 of the long side wall 200 and the bent portion 401*d* of the card presser piece 401 through which the card 407 can pass. Thus, the card 407 is further pushed downward until it has passed through the gap, followed by the abutment of its lower side 407*a* on the top surface of the regulation block 211 or connection block 212. In this manner, the card 407 is held by two or more card holder members 400*a*. The card 407 held by the two or more card holder members 400*a* is brought into pressure contact with the outer surface 201*a* of the plate section 201 of the long side wall 200 by means of the bent portion 401*d* of the card presser piece 401, thereby hindering the card 407 from being moved or disengaged from the container card holder 400 easily.

The above described card holder member 400*a* is molded integrally with the long side wall 200, but if the long side wall 200 is molded of an opaque resin, the card holder member 400*a* is also molded of a similar opaque resin, thereby causing the card 407 held in the card holder member 400*a* to be partly concealed by the card holder member 400*a*. This, to solve such a problem, the card presser piece 401 constituting the card holder member 400*a* is formed into an elongated band.

In addition, by injecting a transparent or translucent resin into a molding space for molding the card presser piece 401 of the card holder member 400*a*, while injecting an appropriate colored resin into a molding space for molding the long side wall 200, the transparent or translucent card holder member 400*a* and the colored long side wall 200 can be integrally molded.

According to the present invention, as described above, the card presser piece 401 constituting the card holder member 400*a* is molded integrally with the long side wall 200 via the thin connection section 402, so that the card holder can be easily assembled simply by rotatively moving the card presser piece 401 toward the outer surface 201*a* of the plate section 201 of the long side wall 200 in a fashion folding the thin connection section 402.

Additionally, since the card presser piece 401 constituting the card holder member 400*a* is formed into an elongated band, only a small part of the card 407 is concealed by the card presser piece 401, thereby allowing easy reading of the destination, name, type, quantity, and the like of articles described or stored in the card 407.

Since the card 407 held in the two or more card holder members 400*a* is brought into pressure contact with the outer surface 201*a* of the plate section 201 of the long side wall 200 by means of the bent portion 401*d* of the card presser piece 401, the card 407 is prevented from being moved or disengaged from the card holder 400 easily.

The assembled card presser piece 401 is located between the piece of regulation blocks 211 formed on the long side wall 200, so that even if an external force is applied to the card presser piece 401 to move it along the outer surface 201*a* of the plate section 201 of the long side wall 200, the regulation blocks 211 restrains this movement to prevent the thin connection section 402, which is relatively fragile, from being damaged, while preventing the card 407 held in the card holder members 400*a* from being disengaged when the card presser piece 401 is moved.

In addition, each long side wall 200 has a notch 216 formed therein by notching the inside of the upper end thereof, and each short side wall 300 has a notch 310 formed therein by notching the inside of the upper end thereof. These notches 216, 310 are configured so that when assembled folding containers are stacked up, the bottom fitting section 100*a* of the bottom portion 100 of the upper folding container is fitted in these notches.

The bottom portion 100, long side walls 200, and short side walls 300 constituting the above described folding container are each molded of a synthetic resin by means of injection molding or the like and then hinged together as described above to assemble the folding container.

Due to the above described configuration, the present invention has the following effects.

The bottom portion of the folding container has formed thereon the locking blocks on which the bottom portion of another folded folding container can be fitted, and the side walls of the folding container has the recesses formed therein and each having the open underside into which the corresponding locking block of the assembled folding container can be inserted, thereby enabling folded folding containers to be stably stacked up. In addition, the engagement an frame sections are used to mutually engage the side walls and to engage the side walls with the bottom portion, thereby allowing the folding container to be firmly assembled in the form of a box.

Since one of the opposed side walls has the through-holes drilled therein and into which the corresponding locking blocks, which project upward, can be inserted upon folding, the locking blocks do not obstruct folding of the folding container.

The engagement projections formed on the engagement frame section of each of the side walls are fitted in the corresponding through-holes formed in the bottom portion. Accordingly, when the folding container is assembled in the form of a box, the bottom portion and the side walls can be coupled together more strongly to regulate the movement of the side walls relative to the bottom portion, thereby preventing substantial movement of the side walls relative to the bottom portion, which may damage the hinge section coupling the bottom portion and the side walls together.

When the side walls are stood up perpendicularly to the bottom portion, the bottom surfaces of the side walls and the top surface of the bottom portion partly come in surface contact with one another. As a result, a load imposed on the side wall can be shared by this surface contact section to prevent the load on the side wall from damaging the hinge section.

Since the card presser pieces each constituting the card holder are integrated with the side wall via the thin connection section, the card holder can be easily assembled simply by rotatively moving the card presser piece toward the side wall in a fashion folding the thin connection section.

What is claimed is:

1. A folding container comprising side walls disposed in a fashion surrounding a bottom portion of the folding container and which can be folded so as to overlap the bottom portion, the side walls each having engagement frame sections formed thereon for engaging the adjacent side walls so that, when stood up perpendicularly with respect to the bottom portion, the side walls will not fall down inward, the bottom portion has locking blocks formed thereon on which the bottom portion of a stacked folded folding container can be fitted, the side walls each have recesses formed therein and each having an open underside into which a cooperating locking block of an assembled folding container can be received, and the engagement frame sections being operative to mutually engage the side walls where the walls are stood up and to engage the side walls with respect to the bottom portion when the side walls are folded, wherein engagement projections formed on the engagement frame sections of each side wall are configured to fit in corresponding through-holes in a cooperating fitting section formed in the bottom portion when each side wall is stood up perpendicularly with respect to the bottom portions, and wherein one of the side walls has through-holes into which the corresponding locking blocks, which project upward, can be inserted upon folding.

2. A folding container according to claim 1, characterized in that when the side walls are stood up perpendicularly to the bottom portion, a bottom surface of each side wall partly comes in surface contact with a top surface of the bottom portion.

3. A folding container according to claim 1, characterized in that card presser pieces each constituting a card holder are integrated with the side wall via a thin connection section.

* * * * *